US007886812B2

(12) United States Patent
Higashiyama

(10) Patent No.: US 7,886,812 B2
(45) Date of Patent: Feb. 15, 2011

(54) HEAT EXCHANGER HAVING A TANK PARTITION WALL

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 1197 days.

(21) Appl. No.: 10/577,330

(22) PCT Filed: Oct. 29, 2004

(86) PCT No.: PCT/JP2004/016475

§ 371 (c)(1),
(2), (4) Date: Apr. 28, 2006

(87) PCT Pub. No.: WO2005/040710

PCT Pub. Date: May 6, 2005

(65) Prior Publication Data

US 2007/0074861 A1 Apr. 5, 2007

Related U.S. Application Data

(60) Provisional application No. 60/518,308, filed on Nov. 10, 2003, provisional application No. 60/528,711, filed on Dec. 12, 2003, provisional application No. 60/530,263, filed on Dec. 18, 2003.

(30) Foreign Application Priority Data

| | | |
|---|---|---|
| Oct. 29, 2003 | (JP) | 2003-368683 |
| Dec. 8, 2003 | (JP) | 2003-408578 |
| Dec. 12, 2003 | (JP) | 2003-414130 |

(51) Int. Cl.
*F28F 9/02* (2006.01)

(52) U.S. Cl. ..... 165/174; 165/172; 62/515; 62/525

(58) Field of Classification Search ..... 165/172, 165/173, 174, 175, 176; 62/515, 525
See application file for complete search history.

(56) References Cited

U.S. PATENT DOCUMENTS

| | | | | |
|---|---|---|---|---|
| 6,272,881 | B1 * | 8/2001 | Kuroyanagi et al. | 165/174 |
| 2005/0172664 | A1 * | 8/2005 | Cho et al. | 165/175 |
| 2006/0162376 | A1 * | 7/2006 | Higashiyama et al. | 62/525 |
| 2006/0213651 | A1 * | 9/2006 | Higashiyama et al. | 165/176 |

FOREIGN PATENT DOCUMENTS

| | | |
|---|---|---|
| JP | 59-63472 | 4/1984 |
| JP | 2003-75024 | 3/2003 |

* cited by examiner

*Primary Examiner*—Ljiljana (Lil) V Ciric
(74) *Attorney, Agent, or Firm*—Oblon, Spivak, McClelland, Maier & Neustadt, L.L.P.

(57) ABSTRACT

A heat exchanger comprising a heat exchange core composed of tube groups in the form of rows arranged in the direction of flow of air through the exchanger, each of the tube groups including a plurality of heat exchange tubes arranged at a spacing. A refrigerant inlet header and a refrigerant outlet header are positioned at the upper end of the core and having respective groups of heat exchange tubes joined thereto. A refrigerant turn tank is disposed at the lower end of the core. The turn tank has its interior divided by a partition wall into a refrigerant inflow header and a refrigerant outflow header. The heat exchange tubes have lower end portions inserted in the headers and are joined to the headers. Refrigerant passing holes are formed in the partition wall. The heat exchange tubes have their lower ends positioned below the lower ends of the holes.

9 Claims, 21 Drawing Sheets

HEAT EXCHANGER HAVING A TANK PARTITION WALL

CROSS REFERENCE TO RELATED APPLICATIONS

This application is an application filed under 35 U.S.C. §111 (a) claiming the benefit pursuant to 35 U.S.C. §119(e) (1) of the filing date of Provisional Applications No. 60/518,308, No. 60/530,263 and No. 60/528,711 filed Nov. 10, 2003, Dec. 18, 2003, and Dec. 12, 2003, respectively, pursuant to 35 U.S.C. §111(b).

TECHNICAL FIELD

The present invention relates to heat exchangers which are useful, for example, as evaporators in motor vehicle air conditioners which are refrigeration cycles to be installed in motor vehicles.

The term "aluminum" as used herein and in the appended claims includes aluminum alloys in addition to pure aluminum. The downstream side (the direction indicated by the arrow X in FIGS. 1, 10 and 18) of the air to be passed through the air flow clearance between each adjacent pair of heat exchange tubes will be referred to herein and in the appended claims as "front," and the opposite side as "rear." Further the left- and right-hand sides of FIGS. 1, 10 and 18 will be referred to as "left" and "right," respectively.

BACKGROUND ART

Heretofore in wide use as motor vehicle evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, the present applicant has already proposed an evaporator which comprise a heat exchange core composed of tube groups in the form of two rows arranged in parallel in the direction of passage of air and each comprising a plurality of heat exchange tubes arranged at a spacing, a refrigerant inlet-outlet tank disposed at the upper end of the heat exchange core and a refrigerant turn tank disposed at the lower end of the heat exchange core, the refrigerant inlet-outlet tank having its interior divided by a partition wall into a refrigerant inlet header and a refrigerant outlet tank arranged side by side in the direction of passage of air, the refrigerant turn tank having its interior divided by a partition wall into a refrigerant inflow header and a refrigerant outflow header arranged side by side in the direction of passage of air, the partition wall of the refrigerant turn tank having a plurality of refrigerant passing holes formed therein and arranged longitudinally of the wall at a spacing, the heat exchange tubes of the front tube group being joined at their upper ends to the refrigerant inlet header, the heat exchange tubes of the rear tube group being joined at their upper ends to the refrigerant outlet header, the heat exchange tubes of the front tube group having their lower ends inserted in and joined to the refrigerant inflow header, the heat exchange tubes of the rear tube group having their lower ends inserted in and joined to the refrigerant outflow header, the lower ends of the heat exchange tubes of the two tube groups being positioned above the lower ends of the refrigerant passing holes. A refrigerant flowing into the inlet header of the inlet-outlet tank flows through the heat exchange tubes of the front tube group into the inflow header of the turn tank, then flows into the outflow header through the refrigerant passing holes in the partition wall and further flows into the outlet header of the inlet-outlet tank through the heat exchange tubes of the rear tube group (see the publication of JP-A NO. 2003-75024).

However, various studies conducted by the present inventor have revealed that the following problems are likely to arise owing to the structure of the evaporator disclosed in the above publication wherein the lower ends of the two groups are positioned above the lower ends of the refrigerant passing holes. The refrigerant flowing into the inflow header from the heat exchange tubes of the front tube group is a mixture of liquid phase and vapor phase, and a major portion of the liquid-phase refrigerant flows into the outflow header directly through the refrigerant passing holes and further flows into the heat exchange tubes of the rear tube group. Consequently, the liquid-phase refrigerant and the vapor-phase refrigerant can not be efficiently mixed together inside the inflow header and inside the outflow header, and the air passing through the heat exchange core becomes uneven at different locations.

We have also found that the evaporator disclosed in the above publication is likely to produce superheat in a wide region, elevating the temperature of the air passing through the heat exchange core. In the case where each tube group comprises an increased number of heat exchange tubes, e.g., at least ten tubes, the refrigerant is likely to flow through some of the tubes without becoming completely vaporized. With the evaporator of the above publication, some of refrigerant passing holes formed in a flow dividing plate in the outlet header are located in the same position as heat exchange tubes when seen from above. When the refrigerant passing through such tubes fails to completely vaporize, the refrigerant enters an upper space directly through the refrigerant passing holes and flows into an expansion valve via a refrigerant outlet. The refrigerant not vaporized completely has a lower temperature, which is detected by the expansion value, which in turn diminishes its valve opening, reducing the rate of flow of the refrigerant and resulting in a larger region of superheat. The superheat region of increased area involving inefficient heat exchange leads to impaired refrigeration performance.

Further with the evaporator of the above publication, the refrigerant inlet of the inlet header and the refrigerant outlet of the outlet header are positioned at the same end of the inlet-outlet tank. Alternatively, such inlet and outlet are formed at the longitudinal midportion of the inlet-outlet tank and positioned close to each other longitudinally thereof. We have found that this position of the inlet and outlet is likely to give rise to the following problems. In the course of flow of the refrigerant from the inlet to the outlet, a large amount of refrigerant flows into heat exchange tubes which are included among those of the front and rear tube groups and which are positioned close to the inlet and outlet, entailing the likelihood that a reduced amount of refrigerant will flow through the heat exchange tubes in other locations. For this reason, the paths of flow of the refrigerant through the evaporator become uneven in length, resulting in an uneven pressure distribution and permitting the refrigerant to flow through all the heat exchange tubes at varying rates. As a result, the air passing through the heat exchange core becomes uneven at different locations. The refrigerant tends to flow at nearly the same rate through heat exchange tubes of the front and rear groups at the same position with respect to the left-right direction. In other words, at a position where the rate of flow of the refrigerant through tubes of the front group is small, the rate of flow of the refrigerant through tubes of the rear group at the same position with respect to the left-right direction is also small. Similarly, at a position where the rate of flow of the refrigerant through tubes of the front group is great, the rate of flow of the refrigerant through tubes of the rear group at the same position with respect to the left-right direction is also great. Thus, the amount of refrigerant contributing to heat exchange becomes uneven with respect to the left-right direction of the heat exchange core, with the result that the air passing through the core becomes also uneven in temperature at different locations. While the refrigerant flowing into the inflow header is a mixture of liquid phase and vapor phase, a major portion of the refrigerant of mixed phase flows directly through the refrigerant passing holes into the outflow header and further into the heat exchange tubes of the rear group. The inflow header and the outflow header therefore fail to efficiently mix together the liquid-phase refrigerant and the vapor-phase refrigerant therein, giving the air passing through the core a temperature varying with the location.

In any case, we have found that the evaporator still remains to be fully improved in heat exchange efficiency.

An object of the present invention is to overcome the above problems and to provide a heat exchanger which exhibits excellent heat exchange performance and which achieves a high refrigeration efficiency when used as an evaporator.

In a first embodiment of the heat exchangers, the end portions of the heat exchange tubes inserted in the inflow header project outward beyond the refrigerant passing holes of the partitioning means longitudinally of the tubes, so that the refrigerant portions flowing into the inflow header from the tubes pass over the outer edges, in the longitudinal direction, of the tubes, flow into the outflow header through the holes and are thereby mixed together. Moreover, the refrigerant flowing into the inflow header is unlikely to pass directly through the holes, therefore partly flows inside the inflow header also longitudinally thereof and is agitated at this time. Accordingly, when used as an evaporator, for example, the heat exchanger efficiently mixes the liquid-phase refrigerant portion and the vapor-phase refrigerant portion to result in a generally uniform quality of wet vapor, giving a generally uniformalized temperature to the air passing through the heat exchange core and realizing an improved refrigeration efficiency, i.e., heat exchange efficiency.

In a second embodiment of the heat exchanger, the refrigerant flowing into the inflow header from the heat exchange tubes is prevented from flowing directly into the outflow header through the refrigerant passing holes. This further improves the refrigerant mixing effect described with reference to the first embodiment. Consequently, when used as an evaporator, for example, the heat exchanger efficiently mixes the liquid-phase refrigerant portion and the vapor-phase refrigerant portion to result in a generally uniform quality of wet vapor, giving a generally more uniformalized temperature to the air passing through the heat exchange core and realizing an improved refrigeration efficiency.

In a third embodiment of the heat exchanger, the refrigerant portions flowing into the outflow header through the refrigerant holes are mixed together also inside the outflow header, with the result that when used as an evaporator, for example, the heat exchanger efficiently mixes the liquid-phase refrigerant portion and the vapor-phase refrigerant portion to result in a generally uniform quality of wet vapor, giving a generally more uniformalized temperature to the air passing through the heat exchange core and realizing an improved refrigeration efficiency.

In another embodiment, the function of the partitioning means provided in the heat exchanger described permits the refrigerant to flow through all the heat exchange tubes joined to the inlet header of the inlet-outlet tank at a uniformalized rate, enabling the exchanger to exhibit improved heat exchange performance.

In another embodiment, the partitioning means of the turn tank of the heat exchanger described in par. 6) is integral with the second member. The partitioning means is therefore easy to provide inside the turn tank.

In another embodiment, the heat exchanger described has a refrigerant inlet at one end of the inlet header and a refrigerant outlet at one end thereof alongside the refrigerant inlet. In such a case, the refrigerant portions flowing from the inlet header into the inflow header via heat exchange tubes will not be fully mixed, while the rate of flow of the refrigerant through all the heat exchange tubes of each tube group will be liable to become uneven. Even in this case, however, the exchanger described achieves a high refrigerant mixing efficiency, enabling the refrigerant to flow through all the tubes at a uniformalized rate.

In another embodiment of the heat exchanger, the separating means functions to uniformalize the rate of flow of the refrigerant through all the heat exchange tubes joined to the inlet header, also uniformalizing the rate of flow of the refrigerant through all the heat exchange tubes joined to the outlet header. The heat exchanger therefore exhibits further improved heat exchange performance.

Another embodiment of the invention, serves to reduce the number of components of the overall heat exchanger.

In another embodiment of the heat exchanger, the inlet-outlet tank partitioning means and separating means are integral with the second member. This ensures facilitated work in providing the partitioning means and the separating means in the interior of the inlet-outlet tank.

In an embodiment, the heat exchange tubes of each tube group is at least seven in number, the refrigerant portions flowing from the inlet header into the inflow header through the heat exchange tubes will not be mixed together sufficiently, and the rate of flow of the refrigerant through all the tubes of each group is liable to become uneven. Even in such a case, however, the refrigerant portions can be mixed efficiently, while the refrigerant flows through all the heat exchange tubes at a uniformalized rate.

In another embodiment of the heat exchanger, the refrigerant portions flowing into the inflow header through the heat exchange tubes will not be mixed together sufficiently, and the rate of flow of the refrigerant through all the tubes of each group is liable to become uneven. Even in such a case, however, the structure immediately above ensures efficient mixing of the refrigerant portions, further permitting the refrigerant to flow through all the heat exchange tubes at a uniformalized rate.

In another embodiment of the heat exchanger, the partitioning means is integral with the second member. The partitioning means is therefore easy to provide inside the tank.

Another embodiment of the heat exchanger is reduced in the number of components in its entirety.

Another embodiment ensures facilitated work in providing the partitioning means in the hollow body.

If the heat exchange tubes joined to each of the inflow header and the outflow header are at least seven in number, the refrigerant portions flowing into the inflow header through the heat exchange tubes will not be mixed together sufficiently, and the rate of flow of the refrigerant through these tubes is liable to become uneven. Even in such a case, however, the refrigerant portions can be mixed efficiently, while the refrigerant flows through all the heat exchange tubes at a uniformalized rate.

In another embodiment of the heat exchanger, the refrigerant passing holes in the separating means of the outlet header are positioned between respective adjacent pairs of heat exchange tubes arranged longitudinally of the outlet header and included in the group of heat exchange tubes joined to the outlet header. Accordingly, the refrigerant flowing out of the tubes comes into contact with the separating means without passing directly through the refrigerant holes to flow inside the outlet header also longitudinally thereof. The refrigerant portions flowing out from all the tubes are therefore mixed together. When the exchanger is used as an evaporator, it is likely that the refrigerant will pass through some heat exchange tubes without completely vaporizing and become lower in temperature. Even in such a case, the refrigerant to be admitted into the expansion valve through the refrigerant outlet is given a relatively high uniform temperature since the refrigerant portions from all heat exchange tubes are mixed together. Consequently, a reduction of the expansion valve opening is prevented to avoid the decrease in the flow of refrigerant, diminishing the region of superheat to result in improved refrigeration performance, i.e., improved heat exchange performance.

In another embodiment of the heat exchanger, the refrigerant passing holes are positioned on the upstream side with respect to the direction of flow of air, so that a larger amount of refrigerant flows on the upstream side. This leads to improved refrigeration performance when the exchanger is used as an evaporator, hence a remarkable advantage in the case where the evaporator has a large front-rear width.

When the heat exchange tubes joined to the outlet header are at least ten in number, a wider region of superheat is likely to result if the exchanger is used as an evaporator. Even in such a case, however, the construction described immediately above precludes an increase of the superheat region.

The heat exchanger described in par. 28) can be reduced in the number of components in its entirety.

In another embodiment of the heat exchanger, the separating means and the partitioning means of the inlet-outlet tank are integral with the second member. This results in facilitated work in providing the separating means and the partitioning means in the interior of the inlet-outlet tank.

While the refrigerant admitted into the inlet header from a refrigerant inlet flows to a refrigerant outlet of the outlet header in one embodiment, the refrigerant flowing into the inflow header at the left from heat exchange tubes flows through the left inflow header longitudinally thereof into the outflow header at the right, then flows through heat exchange tubes into the outlet header. On the other hand, the refrigerant flowing into the inflow header at the right from heat exchange tubes flows through the right inflow header longitudinally thereof into the outflow header at the left, then flows through heat exchange tubes into the outlet header and flows out through the refrigerant outlet. Accordingly, the paths of flow of the refrigerant through the heat exchanger are given equal lengths unlike those described in the aforementioned publication, consequently resulting in a uniform pressure distribution and permitting the refrigerant to pass through all the heat exchange tubes at a uniform rate. This uniformalizes the temperature of the air passing through the heat exchange core. In the case where the refrigerant flows through the heat exchange tubes joined to the left inflow header at a reduced rate, and flows through the heat exchange tubes joined to the right inflow header at an increased rate, the rate of flow of the refrigerant through the tubes joined to the left outflow header increases, and the rate of flow of the refrigerant through the tubes joined to the right outflow header decreases. Conversely in the case where the refrigerant flows through the heat exchange tubes joined to the left inflow header an increased rate, and flows through the heat exchange tubes joined to the right inflow header at a reduced rate, the rate of flow of the refrigerant through the tubes joined to the left outflow header decreases, and the rate of flow of the refrigerant through the tubes joined to the right outflow header increases. This uniformalizes the amount of refrigerant contributing to heat exchange with respect to the left-right direction of the heat exchange core, consequently giving a generally uniform temperature to the air passing through the core. Further when the refrigerant as admitted to the left inflow header flows into the right outflow header, and also when the refrigerant flows from the right inflow header into the left outflow header, these refrigerant portions are mixed together efficiently. Accordingly, when used as an evaporator, the heat exchanger efficiently mixes the liquid-phase refrigerant portion and the vapor-phase refrigerant portion to result in a generally uniform quality of wet vapor, giving a generally uniformalized temperature to the air passing through the heat exchange core and realizing a remarkably improved refrigeration efficiency, i.e., heat exchange efficiency.

When the inlet header has a refrigerant inlet at one end thereof, with the outlet header provided with a refrigerant outlet at its one end alongside the inlet end, the evaporator disclosed in the foregoing publication has a marked tendency for a large amount of refrigerant to flow through heat exchange tubes which are positioned in the vicinity of the refrigerant inlet and outlet and included in the front and rear heat exchange tubes, with a reduced amount of refrigerant flowing through the other heat exchange tubes. Even in such a case, the heat exchanger so constructed as described immediately exhibits the advantages described above.

In another embodiment of the heat exchangers, a relatively simple construction is usable for causing the left inflow header to communicate with the right outflow header and the right inflow header to communicate with the left outflow header.

In another embodiment, the heat exchanger can be smaller in the number of components, and can be provided with the partitioning means in the tank with ease.

In the case where each tube group comprises at least seven heat exchange tubes, the evaporator disclosed in the foregoing publication has a strong tendency for a large amount of refrigerant to flow through heat exchange tubes which are positioned in the vicinity of the refrigerant inlet and outlet and included in the front and rear heat exchange tubes, with a reduced amount of refrigerant flowing through the other heat exchange tubes. Even in such a case, the heat exchanger so constructed as described above exhibits the advantages described with reference to the exchanger described above.

BEST MODE OF CARRYING OUT THE INVENTION

Figure 1:
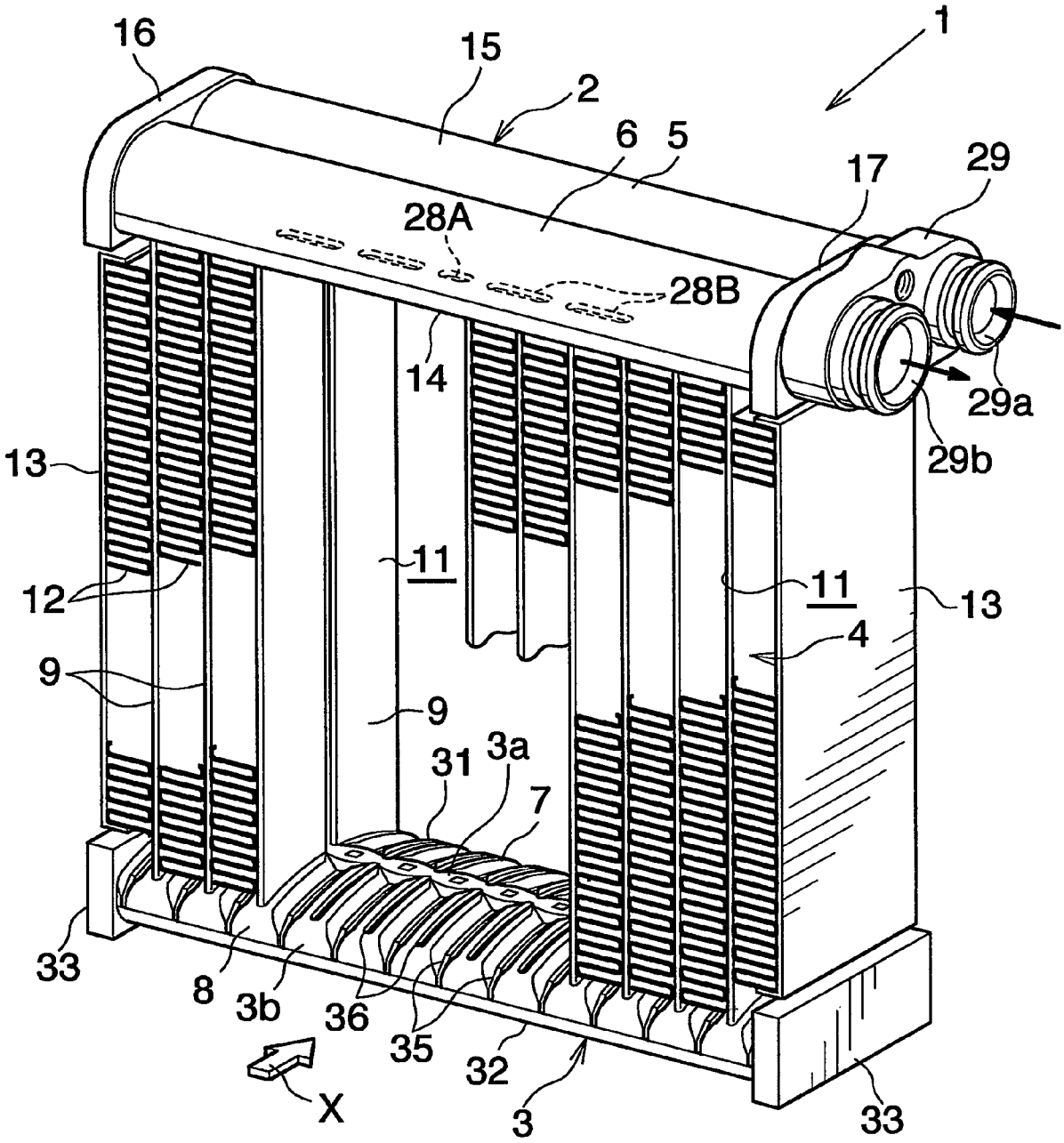
FIG. 1 is a perspective view partly broken away and showing the overall construction of a first embodiment of evaporator of the invention.

Embodiments of the present invention will be described below with reference to the drawings.

Throughout the drawings, like portions and like components are designated by like reference numerals and will not be described repeatedly.

In the following description, the upper and lower sides of FIGS. 1, 10 and 18 will be referred to as "upper" and "lower."

Figure 2:
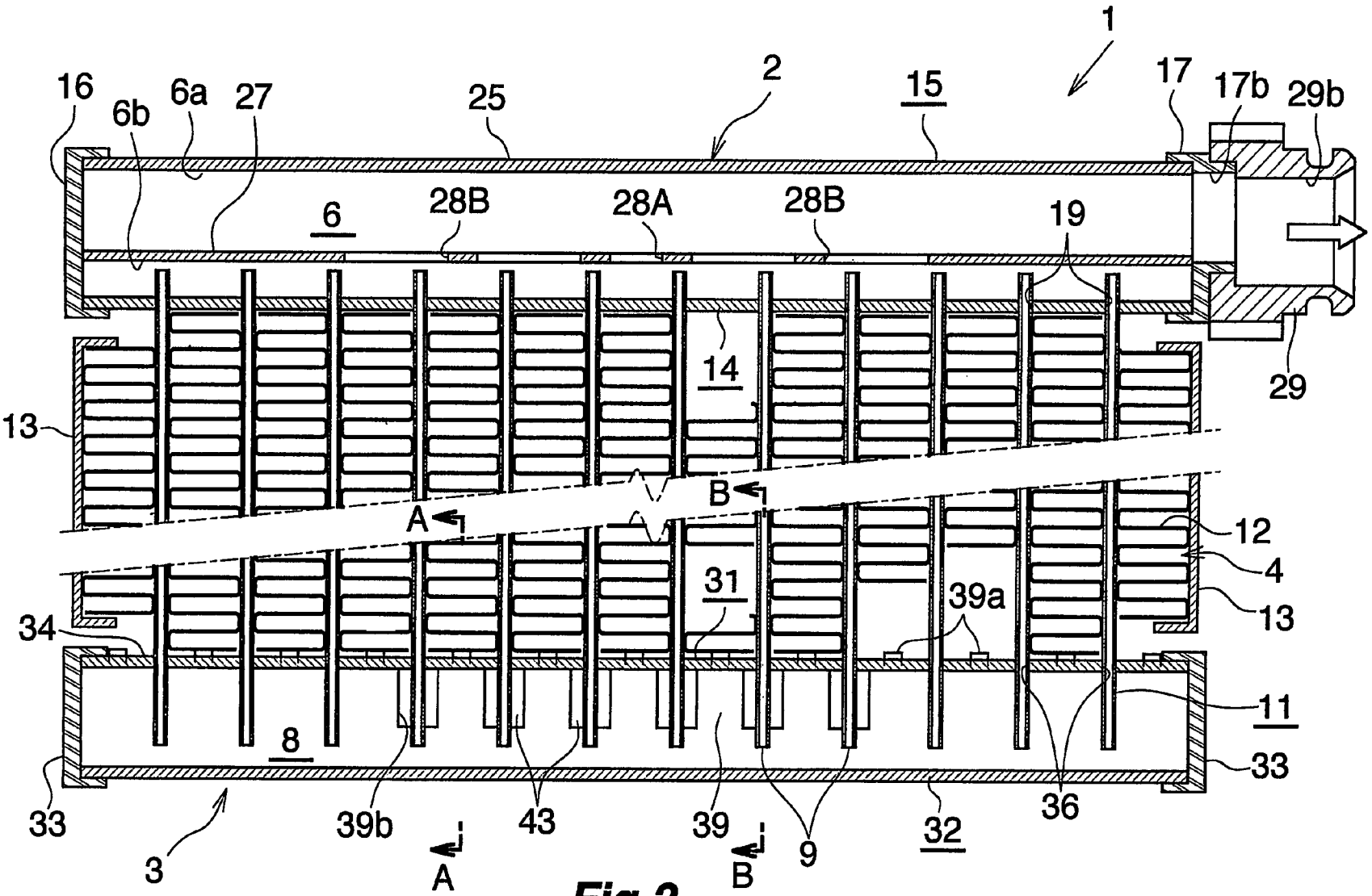
FIG. 2 is a view in vertical section and partly broken away of the evaporator shown in FIG. 1 as it is seen from behind.
Figure 5:
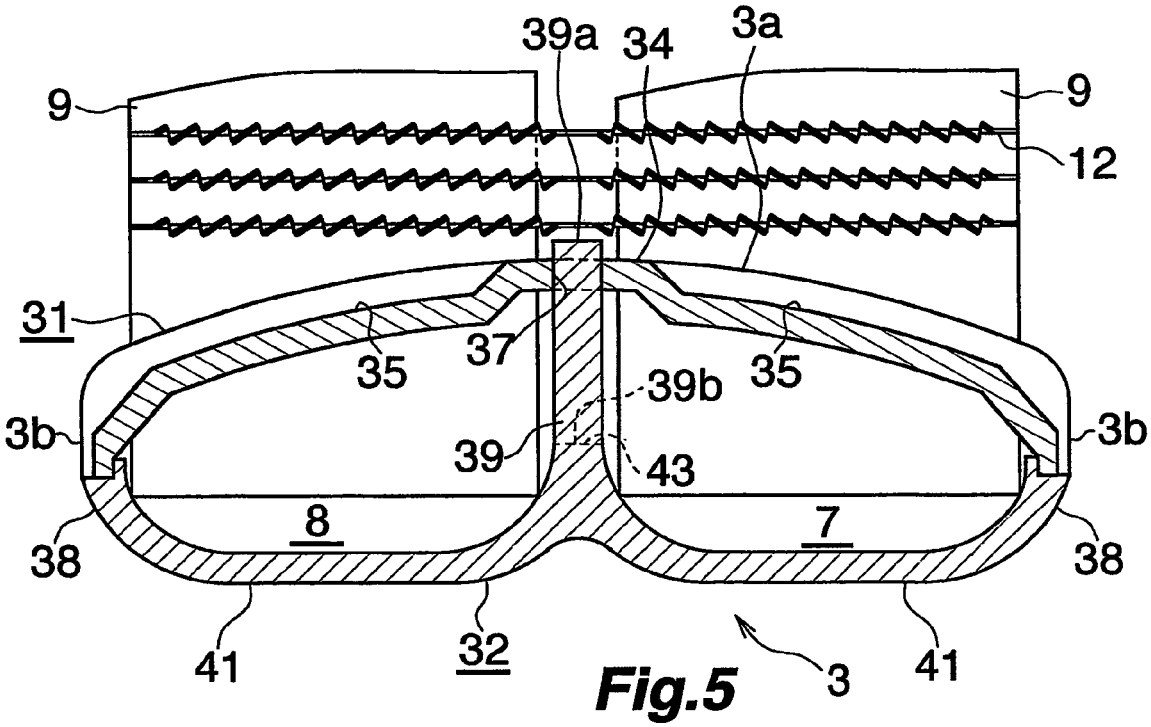
FIG. 5 is an enlarged view in section taken along the line A-A in FIG. 2.
Figure 6:
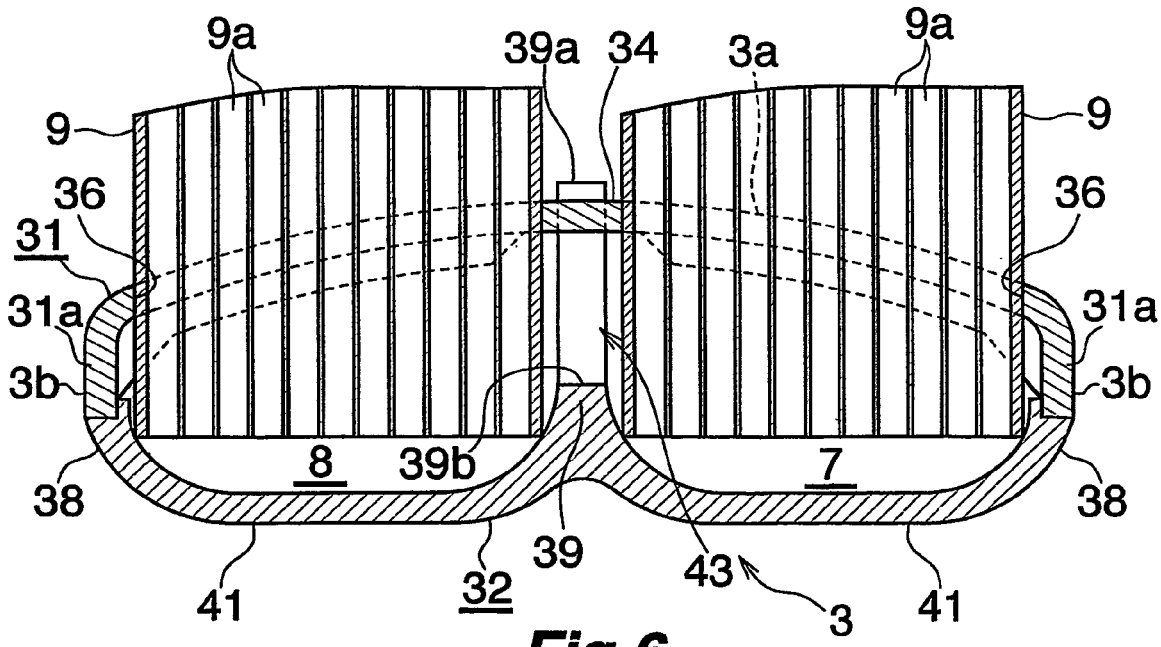
FIG. 6 is an enlarged view in section taken along the line B-B in FIG. 2.
Figure 7:
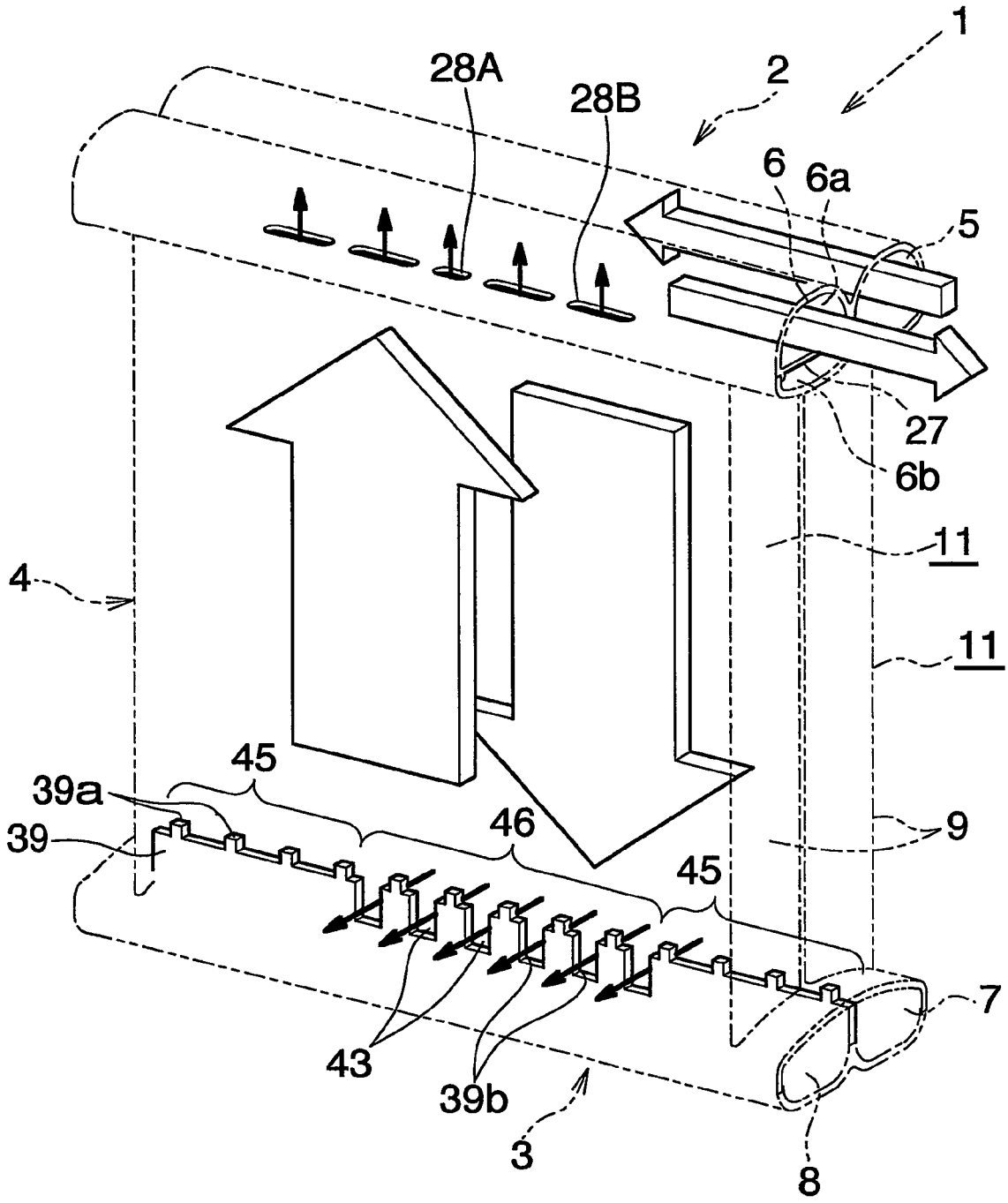
FIG. 7 is a diagram showing how a refrigerant flows through the evaporator shown in FIG. 1.

FIGS. 1 and 2 show the overall construction of a first embodiment of evaporator according to the invention, FIGS. 3 to 6 show the constructions of main parts, and FIG. 7 shows how a refrigerant flows through the evaporator of the first embodiment.

FIGS. 1 and 2 show an evaporator 1 which comprises a refrigerant inlet-outlet tank 2 of aluminum and a refrigerant turn tank 3 of aluminum which are arranged as vertically spaced apart, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator) and elongated in the leftward or rightward direction, and a refrigerant outlet header 6 positioned on the rear side (the upstream side with respect to the flow of air) and elongated in the leftward or rightward direction, the headers 5, 6 being arranged with partitioning means to be described later provided therebetween. The refrigerant turn tank 3 comprises a refrigerant inflow header 7 positioned on the front side and elongated in the leftward or rightward direction, and a refrigerant outflow header 8 positioned on the rear side and elongated leftward or rightward, the headers 7, 8 being arranged with partitioning means to be described later provided therebetween.

The heat exchange core 4 comprises tube groups 11 in the form of a plurality of rows, i.e., two rows in the present embodiment, as arranged forward or rearward, each tube group 11 comprising a plurality of heat exchange tubes 9 of aluminum arranged in parallel leftward or rightward, i.e., laterally of the evaporator, at a spacing. Corrugated aluminum fins 12 are arranged respectively in air passing clearances between respective adjacent pairs of heat exchange tubes 9 of each tube group 11 and also outside the heat exchange tubes 9 at the left and right opposite ends of each tube group 11, and are each brazed to the heat exchange tube 9 adjacent thereto. An aluminum side plate 13 is disposed outside the corrugated fin 12 at each of the left and right ends and brazed to the fin 12. The heat exchange tubes 9 of the front tube group 11 have upper and lower ends joined respectively to the inlet header 5 and the inflow header 7, and the heat exchange tubes 9 of the rear tube group 11 have upper and lower ends joined respectively to the outlet header 6 and the outflow header 8.

Figure 3:
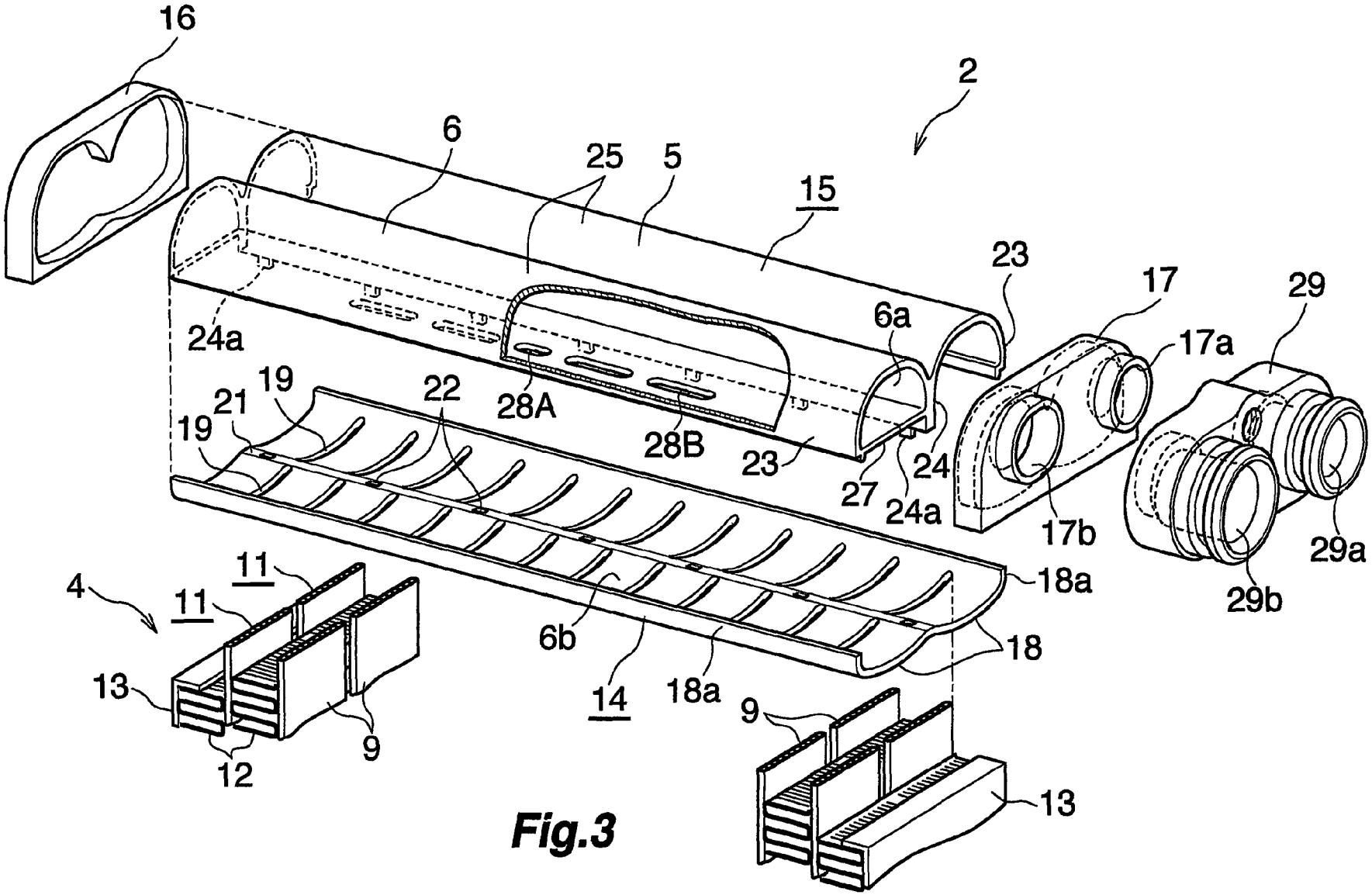
FIG. 3 is an exploded perspective view of a refrigerant inlet-outlet tank of the evaporator shown in FIG. 1.

With reference to FIG. 3, the refrigerant inlet-outlet tank 2 comprises a platelike first member 14 made of an aluminum brazing sheet having a brazing material layer over each of opposite surfaces thereof and having the heat exchange tubes 9 joined thereto, a second member 15 of bare aluminum extrudate and covering the upper side of the first member 14, and aluminum caps 16, 17 closing respective left and right opposite end openings.

The first member 14 has at each of the front and rear side portions thereof a curved portion 18 in the form of a circular arc of small curvature in cross section and bulging downward at its midportion. The curved portion 18 has a plurality of tube insertion slits 19 elongated forward or rearward and arranged at a spacing in the lateral direction. Each corresponding pair of slits 19 in the front and rear curved portions 18 are in the same position with respect to the lateral direction. The front edge of the front curved portion 18 and the rear edge of the rear curved portion 18 are integrally provided with respective upstanding walls 18*a* extending over the entire length of the member 14. The first member 14 includes between the two curved portions 18 a flat portion 21 having a plurality of through holes 22 arranged at a spacing in the lateral direction. The first member 14 is made by forming the curved portions 18, upstanding walls 18*a*, tube insertion slits 19, flat portion 21 and through holes 22 at the same time by press work.

The second member 15 is generally m-shaped in cross section and opened downward and comprises front and rear two walls 23 extending laterally, a partition wall 24 serving as the aforementioned partitioning means, provided in the midportion between the two walls 23 and extending laterally to divide the interior of the refrigerant inlet-outlet tank 2 into front and rear two spaces, and two generally circular-arc connecting walls 25 bulging upward and integrally connecting the partition wall 24 to the respective front and rear walls 23 at their upper ends. The rear wall 23 and the partition wall 24 are integrally interconnected at their lower ends by a flow dividing resistance plate 27 serving as a separating means over the entire length of the member 15. Alternatively, a plate separate from the rear wall 23 and the partition wall 24 may be secured to these walls 23, 24 as the plate 27. The resistance plate 27 has laterally elongated refrigerant passing holes 28A, 28B formed therein at a rear portion thereof other than the left and right end portions of the plate and arranged at a spacing laterally thereof. The refrigerant passing hole 28A in the lateral midportion of the plate 27 has a length smaller than the spacing between adjacent heat exchange tubes 9 of the rear tube group 11, and is formed between the adjacent two heat exchange tubes 9 in the lateral middle of the rear tube group 11. The other refrigerant passing holes 28B have a larger length than the hole 28A in the midportion. The partition wall 24 has a lower end projecting downward beyond the lower ends of the front and rear walls 23 and is integrally provided with a plurality of projections 24*a* projecting downward from the lower edge of the wall 24, arranged at a spacing in the lateral direction and fitted into the through holes 22 of the first member 14. The projections 24*a* are formed by cutting away specified portions of the partition wall 24.

The second member 15 is produced by extruding the front and rear walls 23, partition wall 24, connecting walls 25 and flow dividing resistance plate 27 in the form of an integral piece, thereafter subjecting the extrudate to press work to form the refrigerant passing holes 28A, 28B in the resistance plate 27, and further cutting away portions of the partition wall 24 to form the projections 24*a*.

The caps 16, 17 are made from a bare material as by press work, forging or cutting, each have a recess facing laterally inward for the corresponding left or right ends of the first and second members 14, 15 to fit in. The right cap 17 has a refrigerant inflow opening 17*a*' in communication with the refrigerant inlet header 5, and a refrigerant outflow opening 17*b* communicating with the upper portion of the refrigerant outlet header 6 above the resistance plate 27. Brazed to the right cap 17 is a refrigerant inlet-outlet aluminum member 29 having a refrigerant inlet 29*a* communicating with the refrigerant inflow opening 17*a* and a refrigerant outlet 29*b* communicating with the refrigerant outflow opening 17*b*. An unillustrated expansion valve is attached to the inlet-outlet member 29.

The two members 14, 15 are brazed to each other utilizing the brazing material layer of the first member 14, with the projections 24*a* of the second member 15 inserted in the respective holes 22 of the first member 15 in crimping engagement and with the front and rear upstanding walls 18*a* of the first member 14 in engagement with the front and rear walls 23 of the second member 15. The two caps 16, 17 are further brazed to the first and second members 14, 15 using a brazing material sheet. Thus, the inlet-outlet tank 2 is made. The portion of the tank 2 forwardly of the partition wall 24 of the second member 15 serves as the refrigerant inlet header 5, and the portion thereof rearwardly of the partition wall 24 as the refrigerant outlet header 6. Furthermore, the refrigerant outlet header 6 is divided into upper and lower two spaces 6*a*, 6*b* by the flow dividing resistance plate 27, and these spaces 6*a*, 6*b* are in communication through the refrigerant passing holes 28A, 28B (see FIG. 2). The lower space 6*b* is a first space having inserted therein the heat exchange tubes 9 of the rear tube group 11, and the upper space 6*a* a second space via which the refrigerant flows out of the evaporator. The refrigerant outflow opening 17*b* of the right cap 17 is in communication with the upper space 6*a* of the refrigerant outlet header 6.

Figure 4:
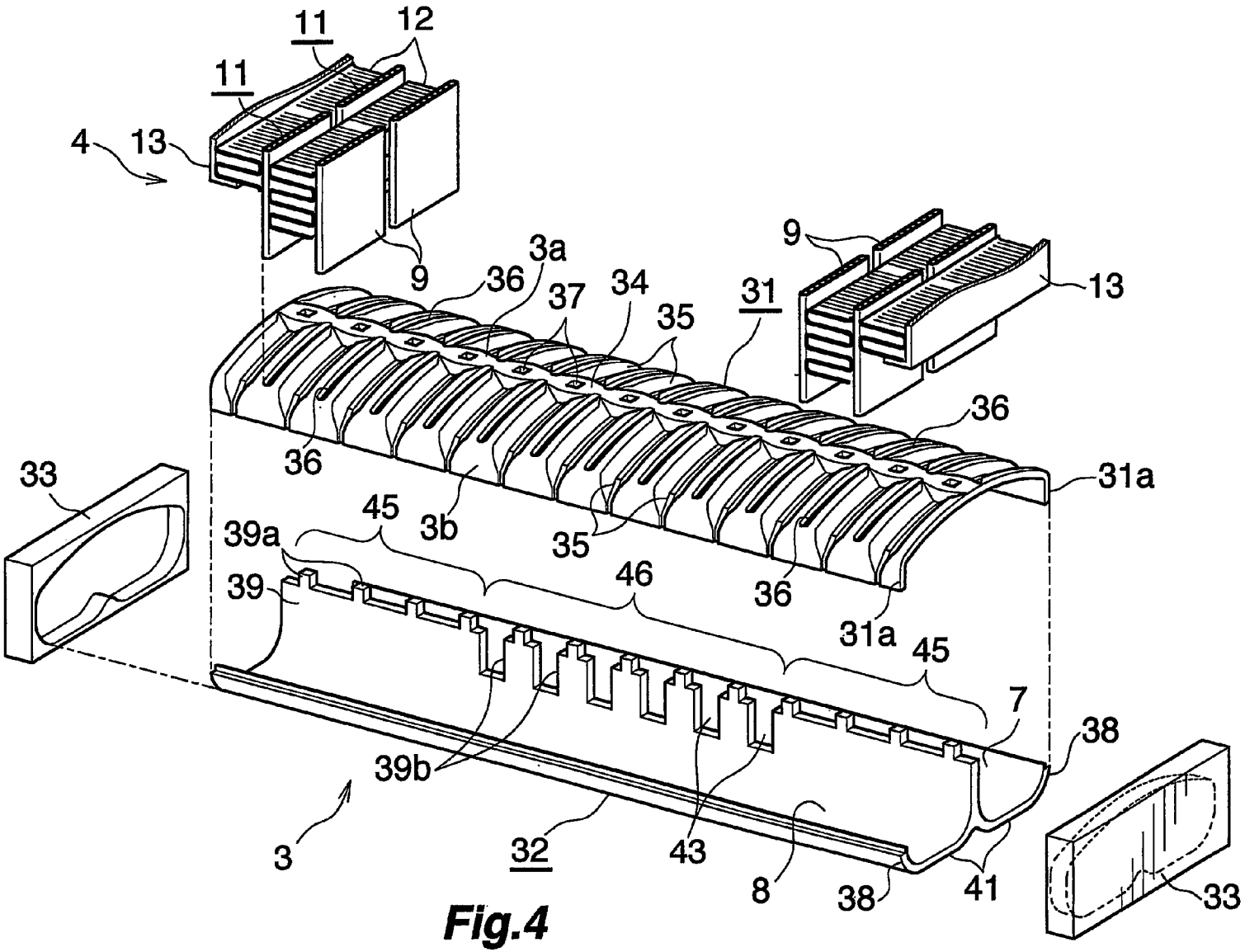
FIG. 4 is an exploded perspective view of a refrigerant turn tank of the evaporator shown in FIG. 1.

With reference to FIGS. 4 to 6, the refrigerant turn tank 3 comprises a platelike first member 31 made of aluminum brazing sheet having a brazing material layer over each of opposite surfaces thereof and having the heat exchange tubes 9 joined thereto, a second member 32 made of bare aluminum extrudate and covering the lower side of the first member 31, and aluminum caps 33 for closing left and right opposite end openings.

The refrigerant turn tank 3 has a top surface 3*a* which is in the form of a circular-arc in cross section in its entirety such that the midportion thereof with respect to the forward or rearward direction is the highest portion 34 which is gradually lowered toward the front and rear sides. The tank 3 is provided in its front and rear opposite side portions with grooves 35 extending from the front and rear opposite sides of the highest portion 34 of the top surface 3*a* to front and rear opposite side surfaces 3*b*, respectively, and arranged laterally at a spacing.

The first member 31 has a circular-arc cross section bulging upward at its midportion with respect to the forward or rearward direction and is provided with a depending wall 31*a* formed at each of the front and rear side edges thereof integrally therewith and extending over the entire length of the member 31. The upper surface of the first member 31 serves as the top surface 3*a* of the refrigerant turn tank 3, and the outer surface of the depending wall 31*a* as the front or rear side surface 3*b* of the tank 3. The grooves 35 are formed in each of the front and rear side portions of the first member 31 and extend from the highest portion 34 in the midportion of the member 31 with respect to the forward or rearward direction to the lower end of the depending wall 31*a*. In each of the front and rear side portions of the first member 31 other than the highest portion 34 in the midportion thereof, tube insertion slits 36 elongated in the forward or rearward direction are formed between respective adjacent pairs of grooves 35. Each corresponding pair of front and rear tube insertion slits 36 are in the same position with respect to the lateral direction. The first member 31 has a plurality of through holes 37 formed in the highest portion 34 in the midportion thereof and arranged laterally at a spacing. The depending walls 31*a*, grooves 35, tube insertions slits 36 and through holes 37 of the first member 31 are formed at the same time by making the member 31 from an aluminum brazing sheet by press work.

The second member 32 is generally w-shaped in cross section and opened upward, and comprises front and rear two walls 38 curved upwardly outwardly forward and rearward, respectively, and extending laterally, a vertical partition wall 39 serving as the aforementioned partitioning means, provided at the midportion between the two walls 38, extending laterally and dividing the interior of the refrigerant turn tank 3 into front and rear two spaces, and two connecting walls 41 integrally connecting the partition wall 39 to the respective front and rear walls 38 at their lower ends. The partition wall 39 is provided with a plurality of projections 39*a* projecting upward from the upper edge thereof integrally therewith, arranged laterally at a spacing and fitted into the respective through holes 37 in the first member 31. The partition wall 39 is provided, in the midportion thereof having a specified length, with refrigerant passing cutouts 39*b* formed in its upper edge between respective adjacent pairs of projections 39*a*. The projections 39*a* and the cutouts 39*b* are formed by cutting away specified portions of the partition wall 39.

The second member 32 is produced by extruding the front and rear walls 38, partition wall 39 and connecting walls 41, and cutting the partition wall 39 to form the projections 39*a* and cutouts 39*b*.

The caps 33 are made from a bare material as by press work, forging or cutting, and each have a recess facing laterally inward for the corresponding left or right ends of the first and second members 31, 32 to fit in.

The first and second members 31, 32 are brazed to each other utilizing the brazing material layer of the first member 31, with the projections 39*a* of the second member 32 inserted through the respective holes 37 in crimping engagement and with the front and rear depending walls 31*a* of the first member 31 in engagement with the front and rear walls 38 of the second member 32. The two caps 33 are further brazed to the first and second members 31, 32 using a brazing material sheet. In this way, the refrigerant turn tank 3 is formed. The portion of the second member 32 forwardly of the partition wall 39 serves as the inflow header 7, and the portion thereof rearwardly of the partition wall 39 as the outflow header 8. The upper-end openings of the cutouts 39*b* in the partition wall 39 of the second member 32 are closed with the first member 31, whereby refrigerant passing holes 43 are formed. The refrigerant passing holes 43, which are formed by closing the upper-end openings of the cutouts 39*b* in the partition wall 39 with the first member 31, can alternatively be through holes formed in the partition wall 39.

The partition plate 39 is provided at its left and right opposite end portions with respective refrigerant barrier portions 45 having no refrigerant passing holes 43 and each extending from the corresponding end of the plate 39 over a predetermined length. Between the barrier portions 45, the plate 39 has a refrigerant passing portion 46 provided with a plurality of refrigerant passing holes 43.

The heat exchange tubes 9 providing the front and rear tube groups 11 are each made of a bare material in the form of an aluminum extrudate. Each tube 9 is flat, has a large width in the forward or rearward direction and is provided in its interior with a plurality of refrigerant channels 9*a* extending longitudinally of the tube and arranged in parallel. The tube 9 has front and rear opposite end walls which are each in the form of an outwardly bulging circular arc. Each corresponding pair of heat exchange tube 9 of the front tube group 11 and heat exchange tube 9 of the rear tube group 11 are in the same position with respect to the leftward or rightward direction, i.e., the lateral direction, have their upper end portions placed into aligned tube insertion slits 19 in the first member 14 of the refrigerant inlet-outlet tank 2 and are brazed to the first member 14 utilizing the brazing material layer of the first member 14, with the tube upper ends projecting into the tank 2. These tubes 9 have their lower end portions placed into aligned tube insertion slits 36 in the first member 31 of the refrigerant turn tank 3 and are brazed to the first member 31 utilizing the brazing material layer of the first member 31, with the tube lower ends projecting into the tank 3. Thus, the heat exchange tubes 9 of the front tube groups 11 are joined to the refrigerant inlet header 5 and the refrigerant inflow header 7, and the heat exchange tubes 9 of the rear tube groups 11 are joined to the refrigerant outlet header 6 and the refrigerant outflow header 8. Each aligned pair of heat exchange tubes 9 of the two tube groups 11 which are positioned in a portion correspond to the refrigerant passing portion 46 are in the same position as the corresponding refrigerant passing hole 43 with respect to the leftward or rightward direction and are positioned at the center of this hole 43 with respect to the leftward or rightward direction (see FIG. 2).

The lower end of each heat exchange tube 9 of the front tube group 11 is positioned below the lower end of the refrigerant passing hole 43 in the partition wall 39, i.e., externally of the lower end of the hole 43 with respect to the lengthwise direction of the tube 9. The distance between the lower end of the heat exchange tube 9 of the front tube group 11 and the lower end of the refrigerant passing hole 43 is preferably 0.5 to 1.5 mm, preferably about 1 mm. The lower end of each heat exchange tube 9 of the rear tube group 11 is positioned at the same level as the lower end of each heat exchange tube 9 of the front tube group 11, and positioned below the lower end of the refrigerant passing hole 43 in the partition wall 39, i.e., externally of the lower end of the hole 43 with respect to the lengthwise direction of the tube 9. The distance between the lower end of the heat exchange tube 9 of the rear tube group 11 and the lower end of the refrigerant passing hole 43 is preferably 0.5 to 1.5 mm, preferably about 1 mm. According to the present embodiment, the lower ends of the heat exchange tubes 11 of the front and rear tube groups 11 are positioned at the same level, whereas this is not limitative. Furthermore, the lower end of the heat exchange tube 9 of the rear tube group 11 need not always be positioned below the lower end of the refrigerant passing hole 43 in the partition wall 39.

Preferably, the heat exchange tube 9 is 0.75 to 1.5 mm in height, i.e., in thickness in the lateral direction, 12 to 18 mm in width in the forward or rearward direction, 0.175 to 0.275 mm in the wall thickness of the peripheral wall thereof, 0.175 to 0.275 mm in the thickness of partition walls separating refrigerant channels from one another, 0.5 to 3.0 mm in the pitch of partition walls, and 0.35 to 0.75 mm in the radius of curvature of the outer surfaces of the front and rear opposite end walls.

In place of the heat exchange tube 9 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer on opposite sides thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate into the shape of a hairpin at the connecting portion and brazing the side wall forming portions to each other in butting relation to form partition walls by the partition forming portions. The corrugated fins to be used in this case are those made from a bare material.

The corrugated fin 12 is made from an aluminum brazing sheet having a brazing material layer on opposite sides thereof by shaping the sheet into a wavy form. Louvers are formed as arranged in parallel in the forward or rearward direction in the portions of the wavy sheet which connect crest portions thereof to furrow portions thereof. The corrugated fins 12 are used in common for the front and rear tube groups 11. The width of the fin 12 in the forward or rearward direction is approximately equal to the distance from the front edge of the heat exchange tube 9 in the front tube group 11 to the rear edge of the corresponding heat exchange tube 9 in the rear tube group 11. It is desired that the corrugated fin 12 be 7.0 mm to 10.0 mm in fin height, i.e., the straight distance from the crest portion to the furrow portion, and 1.3 to 1.8 mm in fin pitch, i.e., the pitch of connecting portions. Instead of one corrugated fin serving for both the front and rear tube groups 11 in common, a corrugated fin may be provided between each adjacent pair of heat exchange tubes 9 of each tube group 11.

The evaporator 1 is fabricated by tacking the components in combination and brazing the tacked assembly collectively.

Along with a compressor and a condenser, the evaporator 1 constitutes a refrigeration cycle, which is installed in vehicles, for example, in motor vehicles for use as an air conditioner.

With reference to FIG. 7 showing the evaporator 1 described, a two-layer refrigerant of vapor-liquid mixture phase flowing through a compressor, condenser and pressure reduction means enters the refrigerant inlet header 5 of the refrigerant inlet-outlet tank 2 via the refrigerant inlet 29*a* of the refrigerant inlet-outlet member 29 and the refrigerant inflow opening 17*a* of the right cap 17 and dividedly flows into the refrigerant channels 9*a* of all the heat exchange tubes 9 of the front tube group 11.

The refrigerant flowing into the channels 9*a* of all the heat exchange tubes 9 flows down the channels 9*a*, ingresses into the refrigerant inflow header 7 of the refrigerant turn tank 3, and flows through the refrigerant passing holes 43 in the refrigerant passing portion 46 of the partition wall 39 into the refrigerant outflow header 8. The refrigerant flowing into the inflow header 7 from the lower ends of the heat exchange tubes 9 at this time temporarily flows upward from below the refrigerant passing holes 43 and moves over the lower edges of the holes 43 when passing through the holes 43, while being prevented from flowing into the outflow header 8 directly through the holes 43 because the lower ends of the tubes 9 are positioned below the lower ends of the refrigerant passing holes 43. Consequently, liquid-phase refrigerant portion and vapor-phase refrigerant portion are mixed together. Since the refrigerant flowing into the inflow header 7 is unlikely to flow through the holes 43 directly, the refrigerant partly flows in the inflow header 7 also longitudinally thereof, with the result that the liquid-phases refrigerant portion and the vapor-phase refrigerant portion are mixed together. The refrigerant flowing into the inflow header 7 from the heat exchange tubes 9 which are positioned in portions corresponding to the refrigerant barrier portions 45 flows toward the refrigerant passing portion 46. As a result, the liquid-phase refrigerant portion and the vapor-phase refrigerant portion are mixed together.

The refrigerant flowing into the outflow header 8 dividedly flows into the refrigerant channels 9*a* of all the heat exchange tubes 9 of the rear tube group 11, changes its course and passes upward through the channels 9*a* into the lower space 6*b* of the refrigerant outlet header 6 of the refrigerant inlet-outlet tank 2. The refrigerant flowing into the outflow header 8 through the refrigerant passing holes 43 at this time flows downward once and then enters the channels 9*a* of the tubes 9 because the lower ends of the tubes 9 are positioned below the lower ends of the holes 43, whereby the liquid-phase refrigerant portion and the vapor-phase refrigerant portion are mixed together. Since the refrigerant flowing into the header 8 flows down once and then enters the channels 9*a* of the tubes 9, the refrigerant partly flows in the header 8 also longitudinally thereof, with the result that the liquid-phase refrigerant portion and the vapor-phase refrigerant portion are mixed together. Furthermore, upon passing through the holes 43, the refrigerant flows leftward and rightward toward opposite sides and flows into the heat exchange tubes 9 positioned in portions corresponding to the barrier portions 45. Consequently, the liquid-phase refrigerant portion and the vapor-phase refrigerant portion are mixed together.

Subsequently, the refrigerant flows through the refrigerant passing holes 28A, 28B of the resistance plate 27 into the upper space 6*a* of the outlet header 6 and flows out of the evaporator via the refrigerant outflow opening 17*b* of the cap 17 and the outlet 29*b* of the refrigerant inlet-outlet member 29. While flowing through the refrigerant channels 9*a* of the heat exchange tubes 9 of the front tube group 11 and the refrigerant channels 9*a* of the heat exchange tubes 9 of the rear tube group 11, the refrigerant is subjected to heat exchange with air flowing through the air passing clearances in the direction of arrow X shown in FIG. 1 and flows out of the evaporator in a vapor phase.

At this time, water condensate is produced on the surfaces of the corrugated fins 12, and the condensate flows down the top surface 3*a* of the turn tank 3. The condensate flowing down the tank top surface 3*a* enters the grooves 35 by virtue of a capillary effect, flows through the grooves 35 and falls off the forwardly or rearwardly outer ends of the grooves 35 to below the turn tank 3. This prevents a large quantity of condensate from collecting between the top surface 3*a* of the turn tank 3 and the lower ends of the corrugated fins 12, consequently preventing the condensate from freezing due to the collection of large quantity of the condensate, whereby inefficient performance of the evaporator 1 is precluded.

In the course of the flow of the refrigerant described above, the refrigerant barrier portions 45 of the partition wall 39 in the turn tank 3 gives resistance to the flow of refrigerant, consequently enabling the refrigerant to flow as uniformly divided from the inlet header 5 into all the heat exchange tubes 9 of the front tube group 11. The resistance given by the resistance plate 27 to the flow of refrigerant also enables the refrigerant to uniformly flow from the outflow header 8 into all heat exchange tubes 9 of the rear tube group 11 and also to flow from inlet header 5 into all the tubes 9 of the front tube group 11 more uniformly. As a result, the refrigerant flows through all the heat exchange tubes 9 of the two tube groups 11 in uniform quantities.

Figure 8:
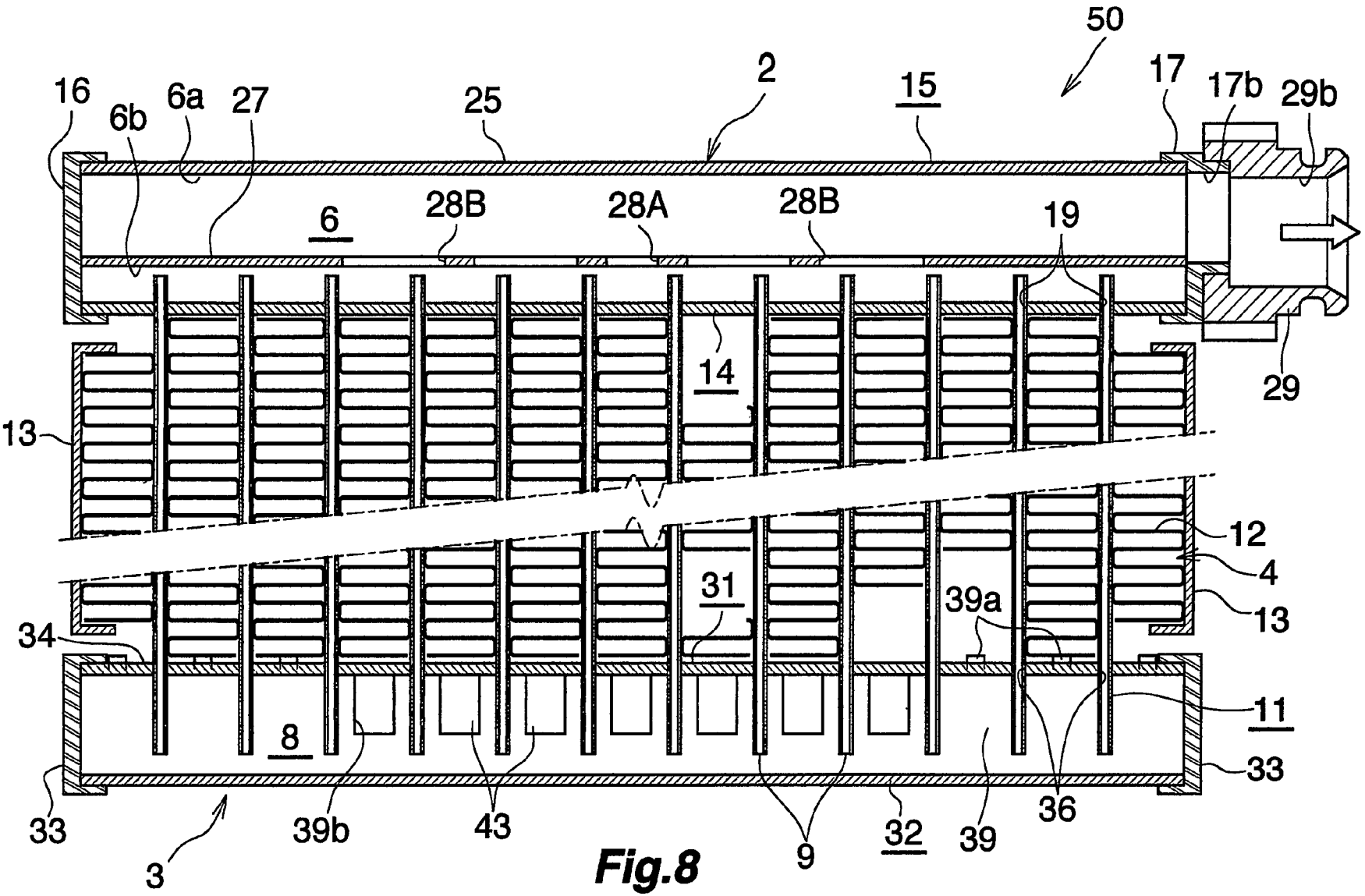
FIG. 8 is a view corresponding to FIG. 2 and showing a second embodiment of evaporator of the invention.

FIG. 8 shows a second embodiment of evaporator according to the invention for use in motor vehicle air conditioners.

In the case of the evaporator 50 of this embodiment shown in FIG. 8, the heat exchange tubes 9 of the front and rear tube groups 11 which are positioned in a portion corresponding to the refrigerant passing portion 46 are arranged between respective adjacent pairs of refrigerant passing holes 43. With the exception of this feature, the second embodiment is the same as the first.

In the case of the second embodiment, the refrigerant flowing into the inflow header 7 from the tubes 9 of the front tube groups 11 is reliably prevented from flowing directly through the refrigerant passing holes 43 into the outflow header 8, so that the liquid-phase refrigerant portion and the vapor-phase refrigerant portion are mixed together more effectively when the refrigerant flows from the inflow header 7 into the outflow header 8 through the passing holes 43 and also when the refrigerant flows out of the header 8 into the tubes 9 of the rear tube group 11.

One group 11 of heat exchange tubes is provided between the inlet header 5 and the inflow header 7 of the two tanks 2, 3, and also between the outlet header 6 and the outflow header 8 thereof, according to the foregoing first and second embodiments, whereas this arrangement is not limitative; one or at least two groups 11 of heat exchange tubes may be provided between the inlet header 5 and the inflow header 7 of the two tanks 2, 3, and also between the outlet header 6 and the outflow header 8 thereof. Although the refrigerant inlet-outlet tank 2 is positioned above the refrigerant turn tank 3 which is at a lower level according to the foregoing embodiments, the evaporator may be used conversely with the turn tank 3 positioned above the inlet-outlet tank 2.

Figure 9:
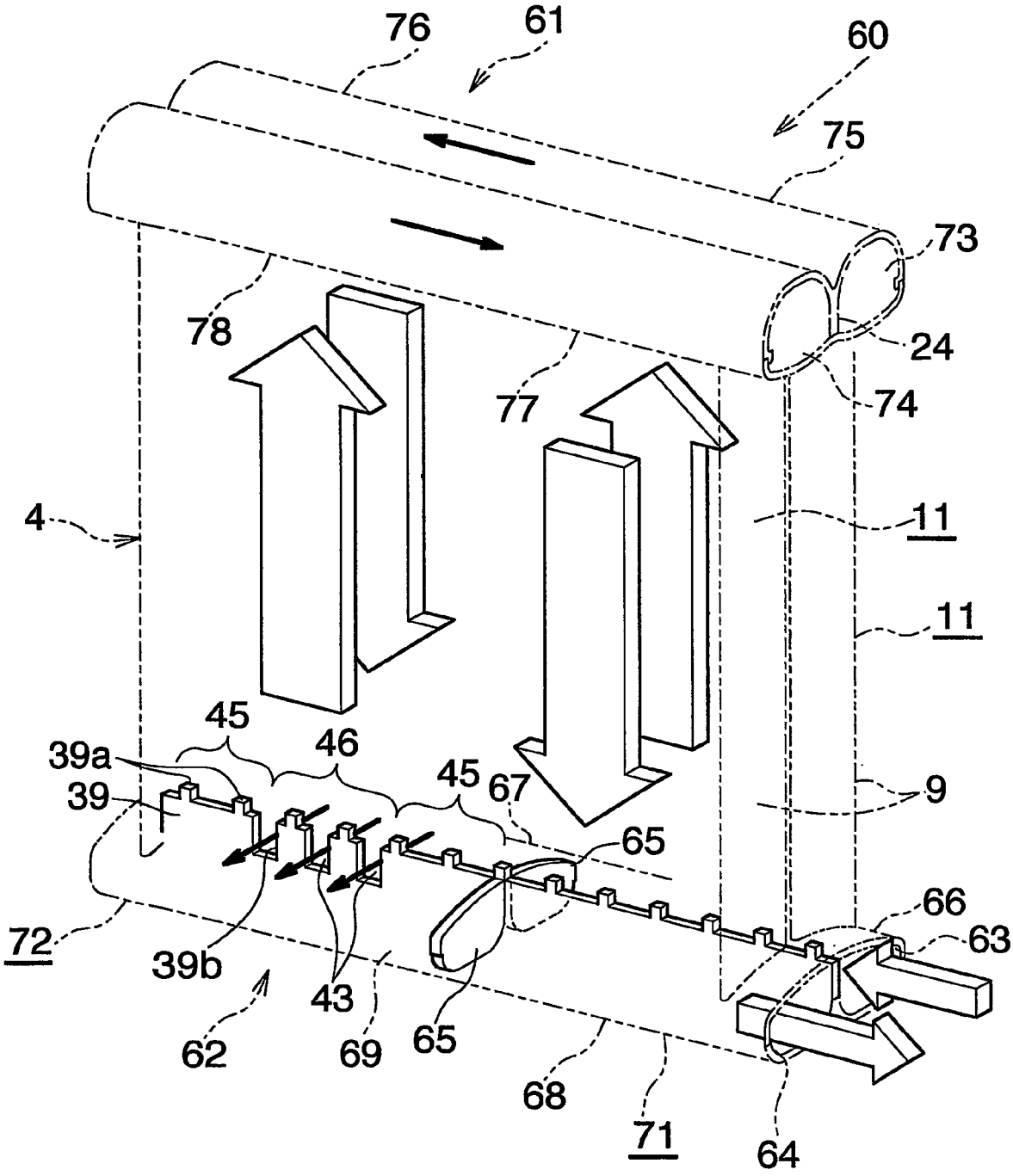
FIG. 9 is a view corresponding to FIG. 7 and showing a third embodiment of evaporator of the invention.

FIG. 9 shows a third embodiment of evaporator according to the invention for use in motor vehicle air conditioners.

In the case of the evaporator 60 of this embodiment shown in FIG. 9, hollow bodies 61, 62 of aluminum are arranged respectively at the upper and lower ends of a heat exchange core 4. The upper hollow body 61 has the same construction as the refrigerant inlet-outlet tank 2 of the first embodiment except that the upper hollow body 61 has no flow dividing resistance plate 27 and that the right end opening is closed with a cap (not shown) having no opening. The upper hollow body 61 is divided by a partition 24 into front and rear two headers 73, 74.

The lower hollow body 62 has a refrigerant passing portion 46 provided in the midportion of the left half of a partition wall 39 and having a plurality of refrigerant passing holes 43. A refrigerant barrier portion 45 having no refrigerant passing holes 43 is provided in the left half of the partition wall 39 at each of the left and right sides of the refrigerant passing portion 46. The hollow body 62 has a right-end opening which is closed with a cap having a refrigerant inflow opening and a refrigerant outflow opening, and a refrigerant inlet-outlet member (not shown) is brazed to the cap (not shown either). With the exception of these features, the lower hollow body 62 has the same construction as the refrigerant turn tank 3 of the first embodiment. The body 62 is divided by a partition wall 39 into front and rear two headers 63, 64. Each of the headers 63, 64 is divided into two header portions 66, 67 (68, 69) by an aluminum partition plate 65 (65) at the midportion thereof with respect to the lateral direction. The portion of the hollow body 62 on the right side of the partition plates 65 serves as a refrigerant inlet-outlet tank 71, and the portion thereof on the left side of the partition plates 65 serves as a refrigerant turn tank 72. The front header portion 66 of the inlet-outlet tank 71 is a refrigerant inlet header, and the rear header portion 68 thereof is a refrigerant outlet header. The front header portion 67 of the turn tank 72 is a refrigerant inflow header, and the rear header portion 69 thereof is a refrigerant outflow header.

The portions of front and rear headers 73, 74 of the upper hollow body 61 opposed to the inlet header 66, inflow header 67, outlet header 68 and outflow header 69 are intermediate header portions 75, 76, 78, 79, respectively. Opposite end portions of heat exchange tubes 9 are joined to the inlet header 66, inflow header 67, outlet header 68 and outflow header 69 and to the intermediate header portions 75, 76, 78, 79. The heat exchange tubes 9 joined to the inflow header 67 and the outflow header 69 of the turn tank 72 have their lower ends positioned below the lower ends of the refrigerant passing holes 43 as in the first embodiment.

In the third embodiment as in the case of the first embodiment, each aligned pair of heat exchange tubes 9 which are positioned in a portion correspond to the refrigerant passing portion 46 may be in the same position as the corresponding refrigerant passing hole 43 with respect to the leftward or rightward direction and may be positioned at the center of this hole 43 with respect to the leftward or rightward direction. Alternatively as in the second embodiment, the heat exchange tubes 9 which are positioned in a portion corresponding to the refrigerant passing portion 46 may be positioned between respective adjacent pairs of refrigerant passing holes 43.

The present embodiment is otherwise the same as the first embodiment.

In the evaporator 60 described, a two-layer refrigerant of vapor-liquid mixture phase flowing through a compressor, condenser and pressure reduction means enters the refrigerant inlet header 66 of the refrigerant inlet-outlet tank 71 via the refrigerant inlet of the refrigerant inlet-outlet member and the refrigerant inflow opening of the cap.

The refrigerant flowing into the inlet header 66 flows upward through the refrigerant channels 9*a* of the heat exchange tubes 9 of the front tube group 11 joined to the header 66 into the right intermediate header portion 75 in the front header 73 of the upper hollow body 61 and further flows into the left header portion 76. As in the first embodiment, the refrigerant thereafter uniformly dividedly flows into the refrigerant channels 9*a* of the heat exchange tubes 9.*of* the front tube group 11 joined to the intermediate header portion 76, flows down the channels 9*a* and enters the inflow header 67 of the turn tank 72.

The refrigerant then flows into the refrigerant outflow header 69 through the refrigerant passing holes 43 of the refrigerant passing portion 46, dividedly flows into the refrigerant channels 9*a* of all the heat exchange tubes 9 of the rear tube group 11 joined to the header 69, changes its course and passes upward through the channels 9*a* into the left intermediate header portion 78 in the rear header 74 of the upper hollow body 61. Subsequently, the refrigerant flows through the right intermediate header portion 77 in the rear header 74, enters the channels 9*a* of heat exchange tubes 9 of the rear tube group 11 joined to the intermediate header portion 77, flows down the channels 9*a* into the outlet header 68 of the inlet-outlet tank 71 and flows out of the evaporator through the refrigerant outflow opening of the cap and the outlet of the inlet-outlet member.

When the refrigerant flowing into the inflow header 67 of the turn tank 72 flows into the outflow header 69 through the passing holes 43 and when the refrigerant flowing into the outflow header 69 flows into the refrigerant channels 9*a* of the heat exchange tubes 9 in the case of the third embodiment, the liquid-phase refrigerant portion and the vapor-phase refrigerant portion are mixed together.

One group 11 of heat exchange tubes is provided between the two intermediate headers 75, 76 which are positioned on the upper front side and the inlet header 66 and the inflow header 67 which are positioned on the lower front side, and also between the two intermediate headers 77, 78 which are positioned on the upper rear side and the outlet header 68 and the outflow header 69 which are positioned on the lower rear side according to the third embodiment, whereas this arrangement is not limitative; one or at least two groups 11 of heat exchange tubes may be provided between these opposed pairs of headers. Although the refrigerant inlet-outlet tank 71 and the refrigerant turn tank 72 are positioned at a lower level according to the third embodiment, the evaporator may be used conversely with the inlet-outlet tank 71 and the turn tank 72 positioned at a higher level.

Figure 10:
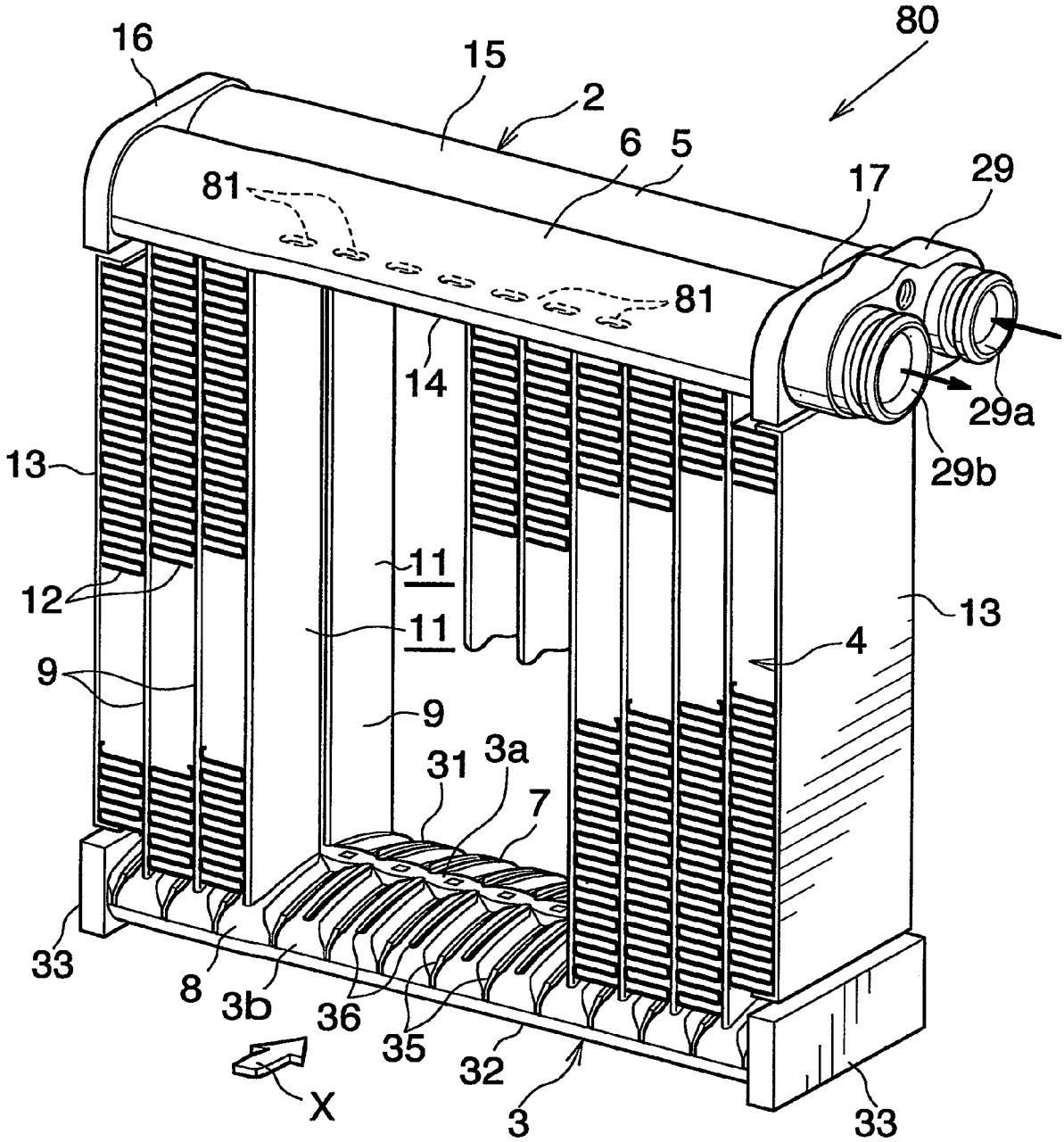
FIG. 10 is a perspective view partly broken away and showing the overall construction of a fourth embodiment of evaporator of the invention.
Figure 11:
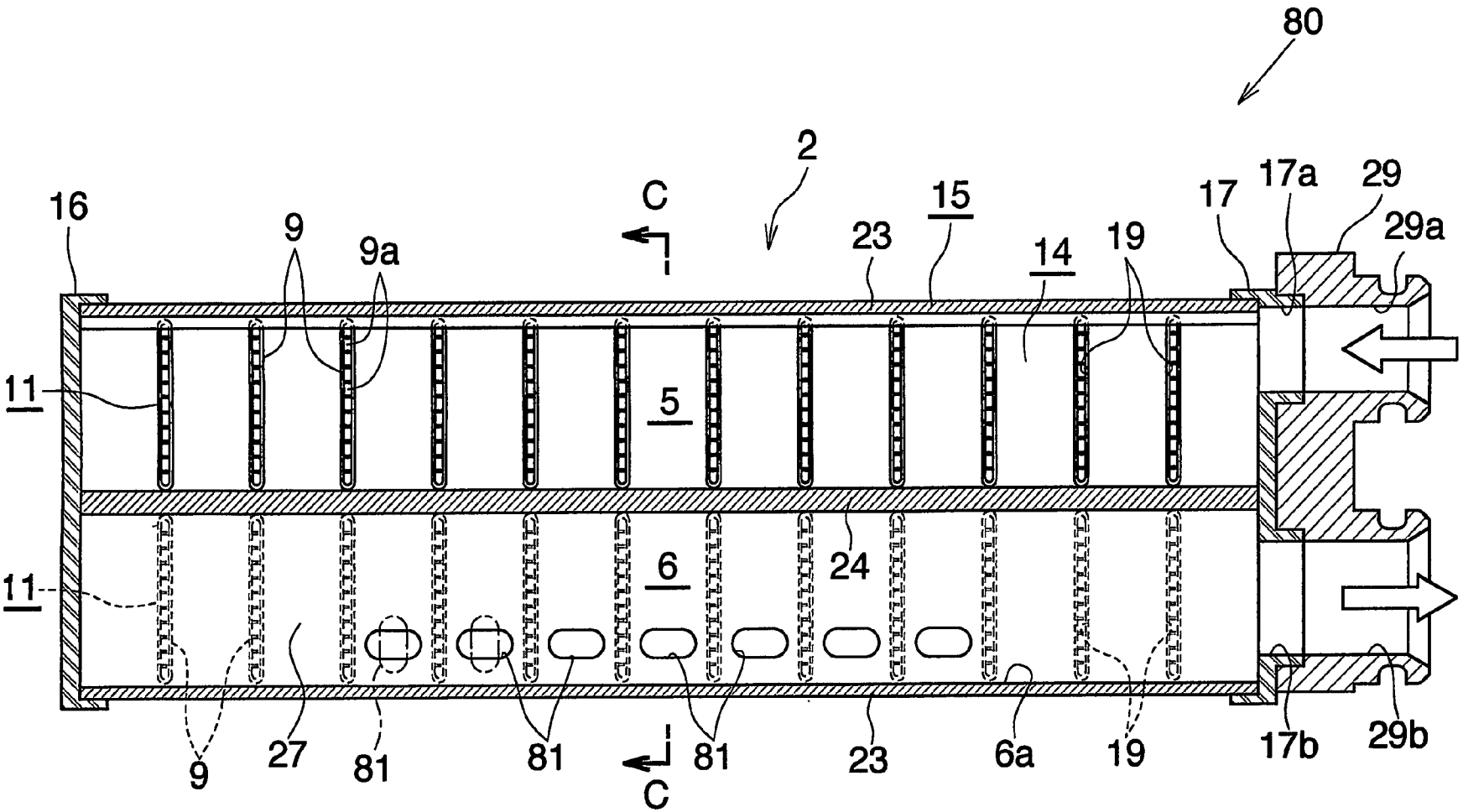
FIG. 11 is a view in horizontal section of a refrigerant inlet-outlet tank of the Evaporator shown in FIG. 10.
Figure 12:
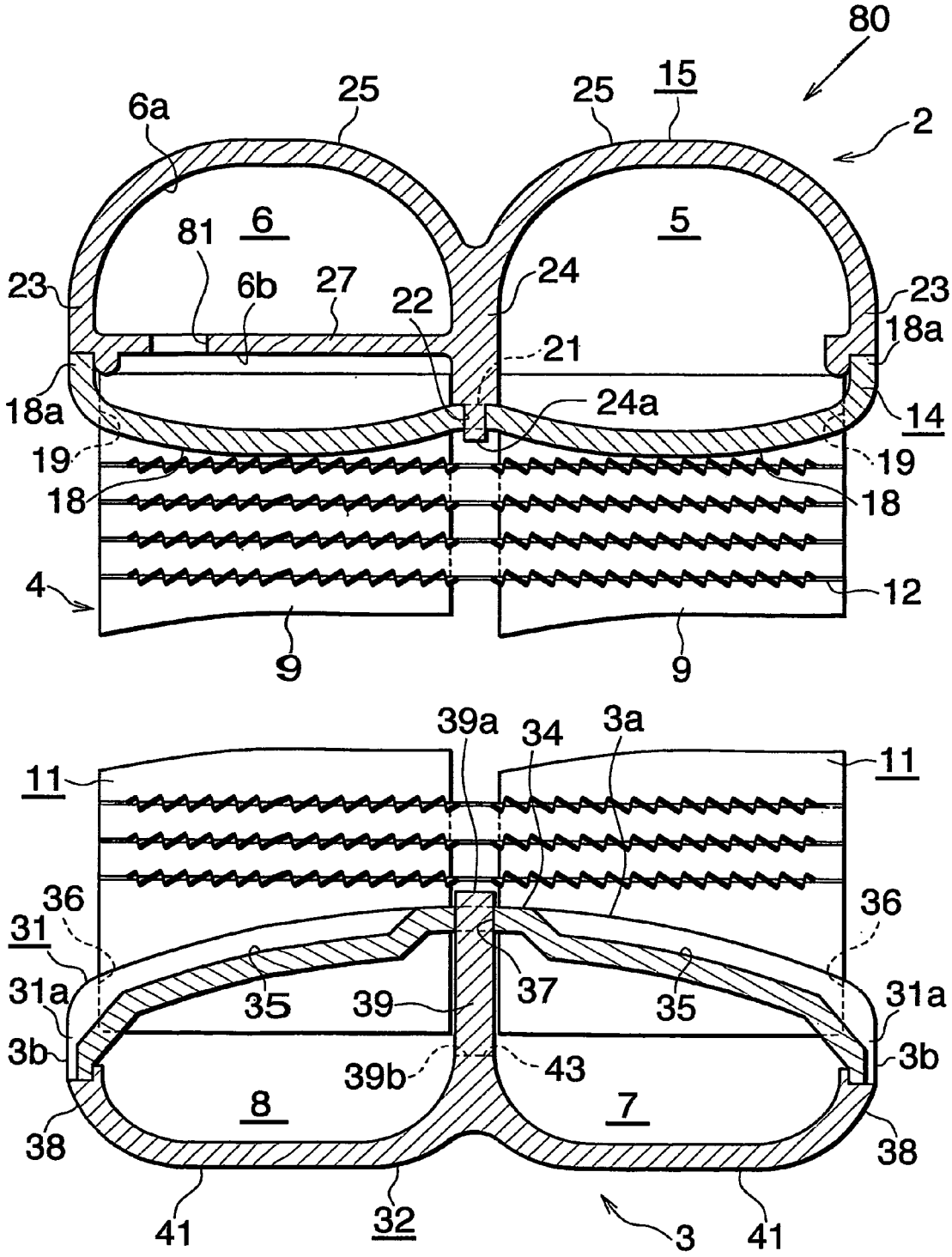
FIG. 12 is an enlarged view in section taken along the line C-C in FIG. 11 and partly broken away.
Figure 13:
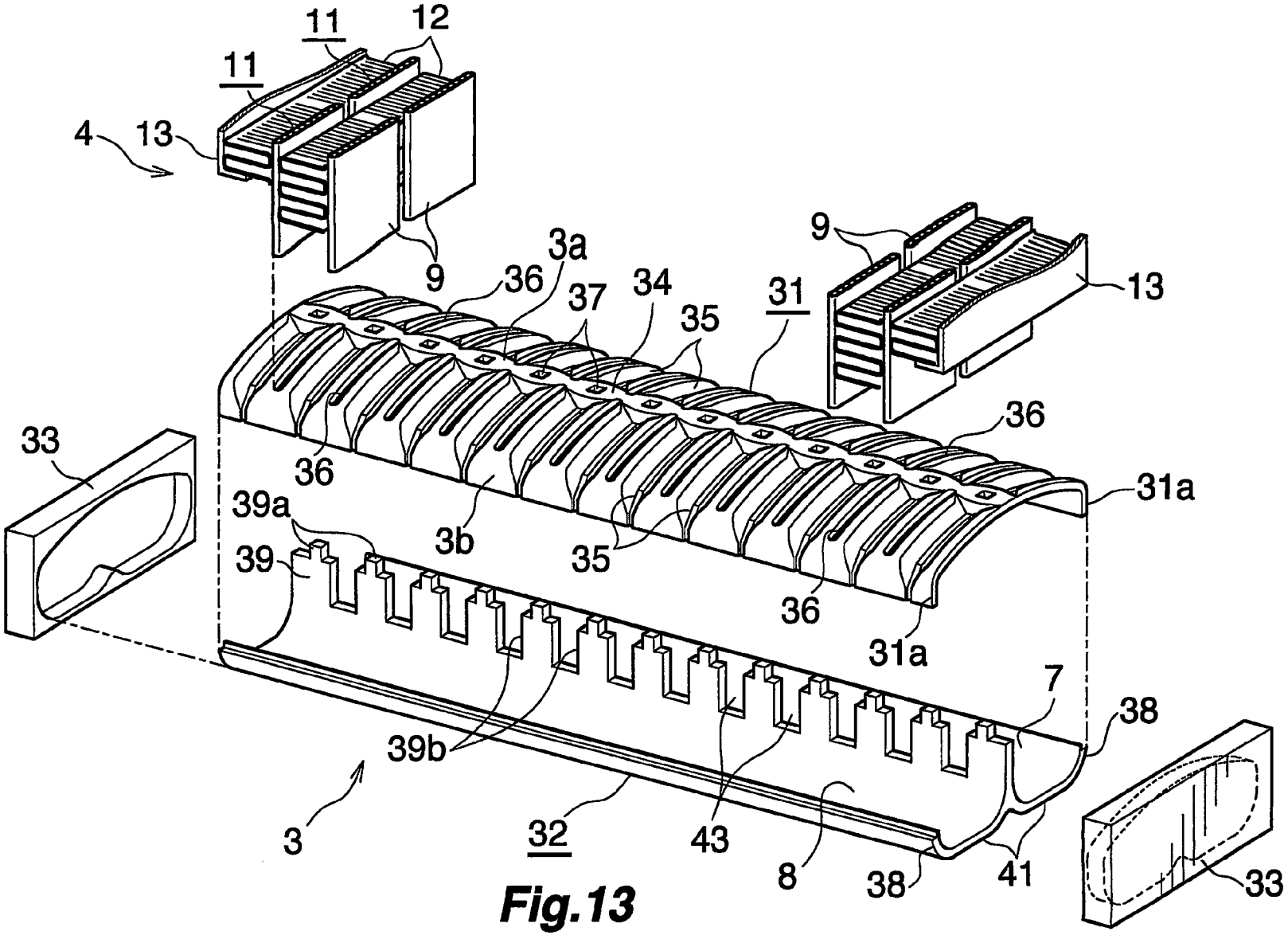
FIG. 13 is an exploded perspective view of a refrigerant turn tank of the evaporator shown in FIG. 10.
Figure 14:
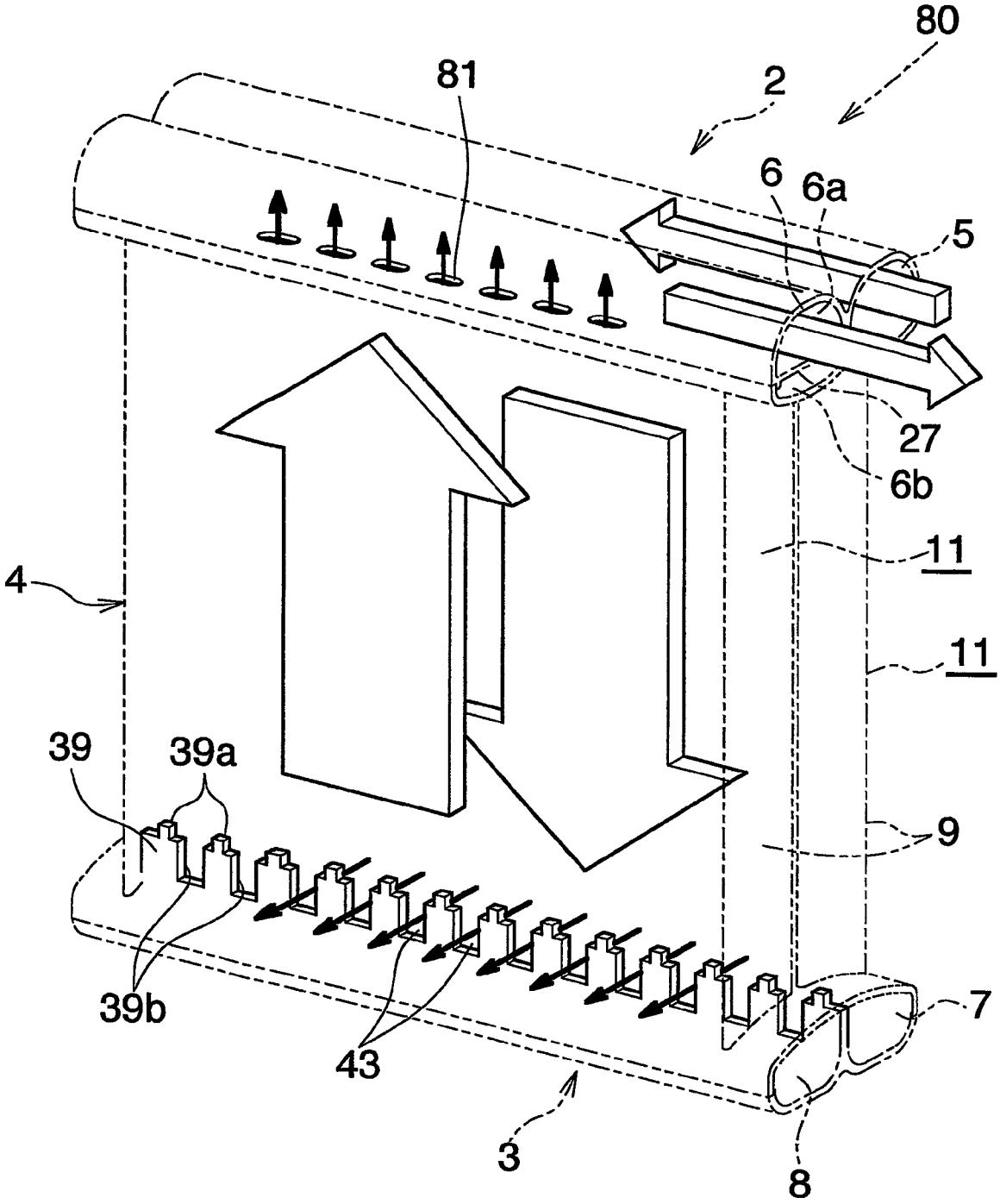
FIG. 14 is a diagram showing how a refrigerant flows through the evaporator shown in FIG. 10.

FIG. 10 shows the overall construction of a fourth embodiment of evaporator according to the invention for use in motor vehicle air conditioners, FIGS. 11 to 13 show the construction of main portions, and FIG. 14 shows how the refrigerant flows through the evaporator of the fourth embodiment.

With reference to FIGS. 10 to 12 showing the evaporator 80 of this embodiment, the refrigerant outlet header 6 of the inlet-outlet tank 2 has its interior divided into upper and lower two spaces 6*a*, 6*b* by a flow dividing resistance plate 27 serving as separating means. The resistance plate 27 is provided, in a rear portion thereof other than left and right opposite end portions thereof, with a plurality of laterally elongated oblong refrigerant passing holes 81 formed therein and arranged at a spacing laterally of the plate so as to be positioned between respective laterally adjacent pairs of heat exchange tubes 9. The refrigerant passing holes 81 are not limited to the laterally elongated oblong form but may be in a forwardly or rearwardly elongated oblong form (see chain lines in FIG. 11), or circular or polygonal, e.g., quadrilateral. The plate may have holes of these shapes in combination.

Further as shown in FIG. 13; the refrigerant turn tank 3 is provided, between its refrigerant inflow header 7 and refrigerant outflow header 8, with a partition wall 39 having a plurality of refrigerant passing holes 43 arranged laterally at a spacing over the entire length thereof.

The lower ends of the heat exchange tubes 9 of the front and rear tube groups 11 are positioned slightly above the lower ends of the refrigerant passing holes 43 (see FIG. 12).

With the exception of these features, the evaporator of the fourth embodiment is the same as the evaporator 1 or 50 of the first or second embodiment described above. The evaporator 80 provides a refrigeration cycle along with a compressor and condenser for use in vehicles, such as motor vehicles, as an air conditioner.

A two-layer refrigerant of vapor-liquid mixture phase flowing through a compressor, condenser and expansion valve flows through the evaporator 80 described as shown in FIG. 14 as in the case of the evaporator 1 of the first embodiment.

The refrigerant passing holes 81 in the flow dividing resistance plate 27 of the outlet header 6 are formed between respective laterally adjacent pairs of heat exchange tubes 9, so that when flowing into the lower space 6*b* of the outlet header 6 from the heat exchange tubes 9 of the rear tube group 11, the refrigerant flowing out of the tubes 9 comes into contact with the resistance plate 27 without passing directly through the holes 81 to flow longitudinally of the outlet header 6 (leftward and rightward), and the refrigerant portions flowing out of all the tubes 9 are mixed together. Accordingly, even if the refrigerant flows through some of the tube 9 without completely vaporizing and has a lower temperature, the refrigerant portions flowing out of all the tubes 9 become mixed together. This gives a relatively high uniform temperature to the refrigerant flowing into the expansion valve via the outflow opening 17*b* and the outlet 29*b* of the refrigerant inlet-outlet member 29. Consequently, a reduction of the expansion valve opening is prevented to avoid the decrease in the flow of refrigerant, diminishing the region of superheat to result in improved refrigeration efficiency.

One group 11 of heat exchange tubes is provided between the inlet header 5 and the inflow header 7 of the two tanks 2, 3, and also between the outlet header 6 and the outflow header 8 thereof according to the foregoing fourth embodiment, whereas this arrangement is not limitative; one or at least two groups 11 of heat exchange tubes may be provided between the inlet header 5 and the inflow header 7 of the two tanks 2, 3, and also between the outlet header 6 and the outflow header 8 thereof. The evaporator may be used with the turn tank 3 positioned above the inlet-outlet tank 2.

Next, the fourth embodiment will be described with reference to a specific example along with a comparative example.

Example 1

Figure 15:
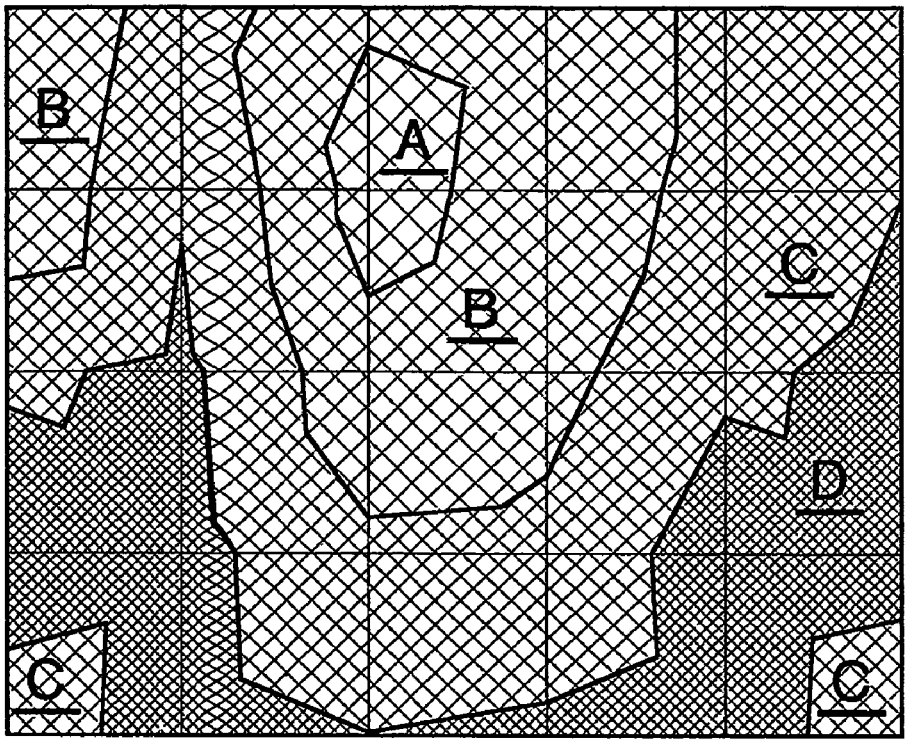
FIG. 15 is a diagram showing the result of Example 1 achieved by the fourth embodiment.

The evaporator shown in FIGS. 10 to 13 was used. The heat exchange core 4 measured 255 mm in lateral width and 38 mm from front to back, the heat exchange tubes 9 of each tube group 11 were 26 in number, 1.4 mm in height and 17.7 mm in width, and the corrugated fins 12 were 3.3 mm in fin pitch and 8 mm in height. The refrigerant passing holes 81 in the flow dividing resistance plate 27 were 13 in number. The temperature distribution of the air forced out from the front side of the heat exchange core 4 was measured according to JIS D1618. FIG. 15 shows the result.

Comparative Example 1

Figure 16:
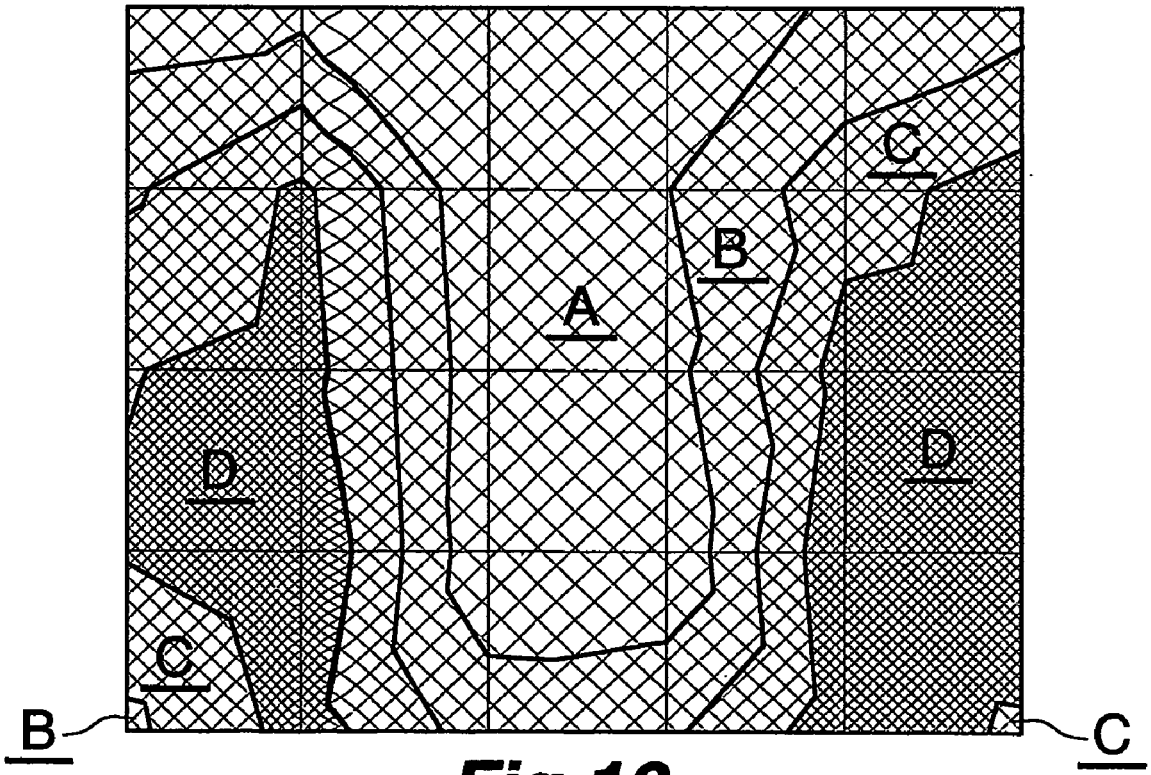
FIG. 16 is a diagram showing the result of Comparative Example 1.

Prepared in this example was the same as the one used in Example 1 except that the flow dividing resistance plate 27 had refrigerant passing holes 28A, 28B similar to those of the first embodiment described. The hole 28A in the center with respect to the lateral direction was positioned between the two heat exchange tubes 9 in the central portion with respect to the lateral direction, two holes 28B were arranged on each of the left and right sides of the hole 28A in the center, and these holes 28B were positioned as opposed to the upper ends of heat exchange tubes 9. The temperature distribution of the air forced out from the front side of the heat exchange core 4 was measured according to JIS D1618. FIG. 16 shows the result.

With reference to FIGS. 15 and 16, region A is a region with a temperature of 8 to 9° C., region B is a region with a temperature of 7 to 8° C., region C is a region with a temperature of 6 to 7° C., and region D is a region with a temperature of 5 to 6° C. Region A is the superheat region.

FIGS. 15 and 16 reveal that the superheat region in the case of Example 1 is smaller than the superheat region of Comparative Example 1.

Figure 17:
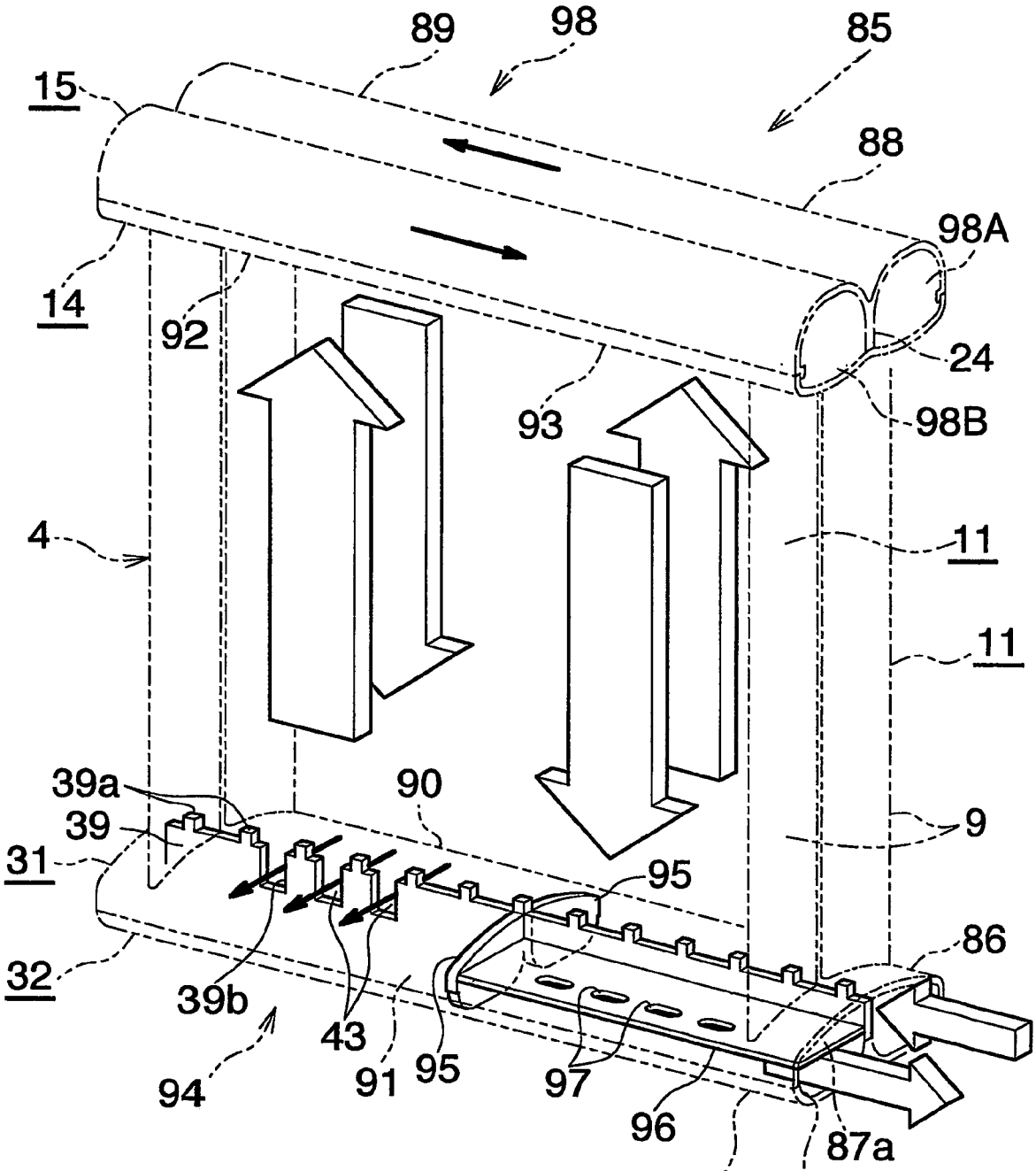
FIG. 17 is a view corresponding to FIG. 14 and showing a fifth embodiment of evaporator of the invention.

FIG. 17 shows a fifth embodiment of evaporator according to the invention for use in motor vehicle air conditioners.

The evaporator 85 shown in FIG. 17 comprises a refrigerant inlet header 86 and a refrigerant outlet header 87 which are arranged side by side from the front rearward, a first intermediate header 88 provided above the inlet header 86 and spaced apart therefrom, a second intermediate header 89 provided on the left side of the first intermediate header 88, a third intermediate header 90 disposed below and spaced apart from the second intermediate header 89 and positioned on the left side of the inlet header 86, a fourth intermediate header 91 provided alongside the third intermediate header 90 on the rear side thereof and positioned on the left side of the outlet header 87, a fifth intermediate header 92 provided above and spaced apart from the fourth intermediate header 91 and disposed alongside the second intermediate header 89 on the rear side thereof, and a sixth intermediate header 93 disposed above and spaced part from the outlet header 87 and positioned on the right side of the fifth intermediate header 92.

The inlet header 86, outlet header 87, third intermediate header 90 and fourth intermediate header 91 are formed by separating one tank 94 into four portions arranged from the front rearward and from the left to the right. The tank 94 is similar to the refrigerant turn tank 3 of the first embodiment and comprises a first member 31 and a second member 32. The tank 94 differs from turn tank 3 with respect to the following. The tank 94 is divided into a front and a rear space by a partition wall 39 inside the tank, and each of these spaces is divided into a left and a right portion by an aluminum partition plate 95 disposed at the midportion with respect to the leftward or rightward direction, whereby four headers 86, 87, 90, 91 are provided. The portion of the partition wall 39 on the right side of the partitions 95 has no refrigerant passing holes 43, and the inlet header 86 is held out of communication with the outlet header 87. The outlet header 87 has its interior divided into upper and lower two spaces 87*a*, 87*b* by a flow dividing resistance plate 96 provided between and brazed to the rear depending wall 31*a* of the first member 31 and the partition wall 39. The resistance plate 96 is provided with a plurality of laterally elongated oblong refrigerant passing holes 97 positioned between respective laterally adjacent pairs of heat exchange tubes 9 of the rear group 11. Although not shown, a cap 33 for closing right-end openings has a refrigerant inflow opening communicating with the inlet header 86 and a refrigerant outflow opening communicating with the lower space 87*b* of the outlet header 87. Brazed to the outer wall of the cap 33 is a refrigerant inlet-outlet member 29 having a refrigerant inlet 29*a* communicating with the inflow opening and a refrigerant outlet 29*b* communicating with the outflow opening.

The first intermediate header 88, the second intermediate header 89, the fifth intermediate header 92 and the sixth intermediate header 93 are formed by separating one tank 98 into front and rear two divisions 98A, 98B. The right side portion of the front division 98A provides the first intermediate header 88, and the left side portion thereof provides the second intermediate header 89. The right side portion of the rear division 98B provides the sixth intermediate header 93, and the left side portion thereof provides the fifth intermediate header 92. The tank 98 is similar to the inlet-outlet tank 2 of the first embodiment in construction and comprises a first member 14 and a second member 15. The tank 98 differs from the inlet-outlet tank 2 with respect to the following. The tank 98 has no flow dividing resistance plate 27. A cap 17 for closing the right-end openings is not provided with the inflow opening 17*a* or outflow opening 17*b*. An inlet-outlet member 29 is not brazed to the cap 17.

A heat exchange core 4 is provided between the assembly of the inlet header 86, outlet header 87, third intermediate header 90 and fourth intermediate header 91 and the assembly of the first intermediate header 88, second intermediate header 89, fifth intermediate header 92 and sixth intermediate header 93. Heat exchange tubes 9 of a front tube group 11 have their lower end portions joined to the inlet header 86 and the third intermediate header 90 and have their upper end portions joined to the first intermediate header 88 and the second intermediate header 89. Further heat exchange tube 9 of a rear tube group 11 have their lower end portions joined to the outlet header 87 and the fourth intermediate header 91 and have their upper end portions joined to the sixth intermediate header 93 and the fifth intermediate header 92.

With reference to FIG. 17 showing the evaporator 85 described, a two-layer refrigerant of vapor-liquid mixture phase flowing through a compressor, condenser and expansion valve enters the refrigerant inlet header 86 via the refrigerant inlet 29*a* of the refrigerant inlet-outlet member 29 and the refrigerant inflow opening of the right cap 33 and dividedly flows into the refrigerant channels 9*a* of all the heat exchange tubes 9 joined to the inlet header 86 and included in the front tube group 11. The refrigerant flows up the channels 9*a*, enters the first intermediate header 88, and flows leftward into the second intermediate header 89. The refrigerant in this header 89 dividedly flows into the refrigerant channels 9*a* of all the heat exchange tubes 9 joined to the second intermediate header 89 and included in the front tube group 11, flows down the channels 9*a*, enters the third intermediate header 90 and flows into the fourth intermediate header 91 through the refrigerant passing holes 43. The refrigerant in the header 91 then dividedly flows into the refrigerant channels 9*a* of all the heat exchange tube 9 joined to the fourth intermediate header 91 and included in the rear tube group 11, flows up the channels 9*a*, enters the fifth intermediate header 92 and flows rightward into the sixth intermediate header 93. The refrigerant in the header 93 then dividedly flows into the channels 9*a* of all the heat exchange tubes 9 joined to the header 93 and included in the rear tube group 11, flows down the channels 9*a* and enters the upper space 87*a* of the outlet header 87.

Subsequently, the refrigerant flows through the refrigerant passing holes 97 of the flow dividing resistance plate 96 into the lower space 87*b* of the outlet header 87 and flows toward the expansion valve through the outflow opening of the cap 33 and the outlet 29*b* of the refrigerant inlet-outlet member 29.

Because the refrigerant passing holes 97 in the resistance plate 96 of the outlet header 87 are positioned between the respective laterally adjacent pairs of heat exchange tubes 9, the refrigerant flowing out of the tubes 9 of the rear group 11 comes into contact with the resistance plate 96 and flows longitudinally of the header 87 (leftward and rightward) without passing directly through the holes 97 when flowing into the upper space 87*a* of the outlet header 87, whereby the refrigerant portions flowing through all the tubes 9 are mixed together. Accordingly, even if the refrigerant passes through some of the tubes 9 without completely vaporizing and becomes lower in temperature, the refrigerant to be admitted into the expansion valve through the refrigerant outflow opening and outlet 29*b* is given a relatively high uniform temperature since the refrigerant portions from all the tubes 9 are mixed together. Consequently, a reduction of the expansion valve opening is prevented to avoid the decrease in the flow of refrigerant, diminishing the region of superheat to result in an improved refrigeration efficiency.

One group 11 of heat exchange tubes is provided between the inlet header 86 and the third intermediate header 90, and the first and second intermediate headers 88, 89 of the two tanks 94, 98, and also between the outlet header 87 and the fourth intermediate header 91, and the sixth and fifth intermediate headers 93, 92, according to the foregoing fifth embodiment, whereas this arrangement is not limitative; one or at least two groups 11 of heat exchange tubes may be provided between the headers 86, 90 and the headers 88, 89 and between the headers 87, 91 and the headers 93, 92. The evaporator may be used with the tank 94 positioned above the tank 98.

Figure 18:
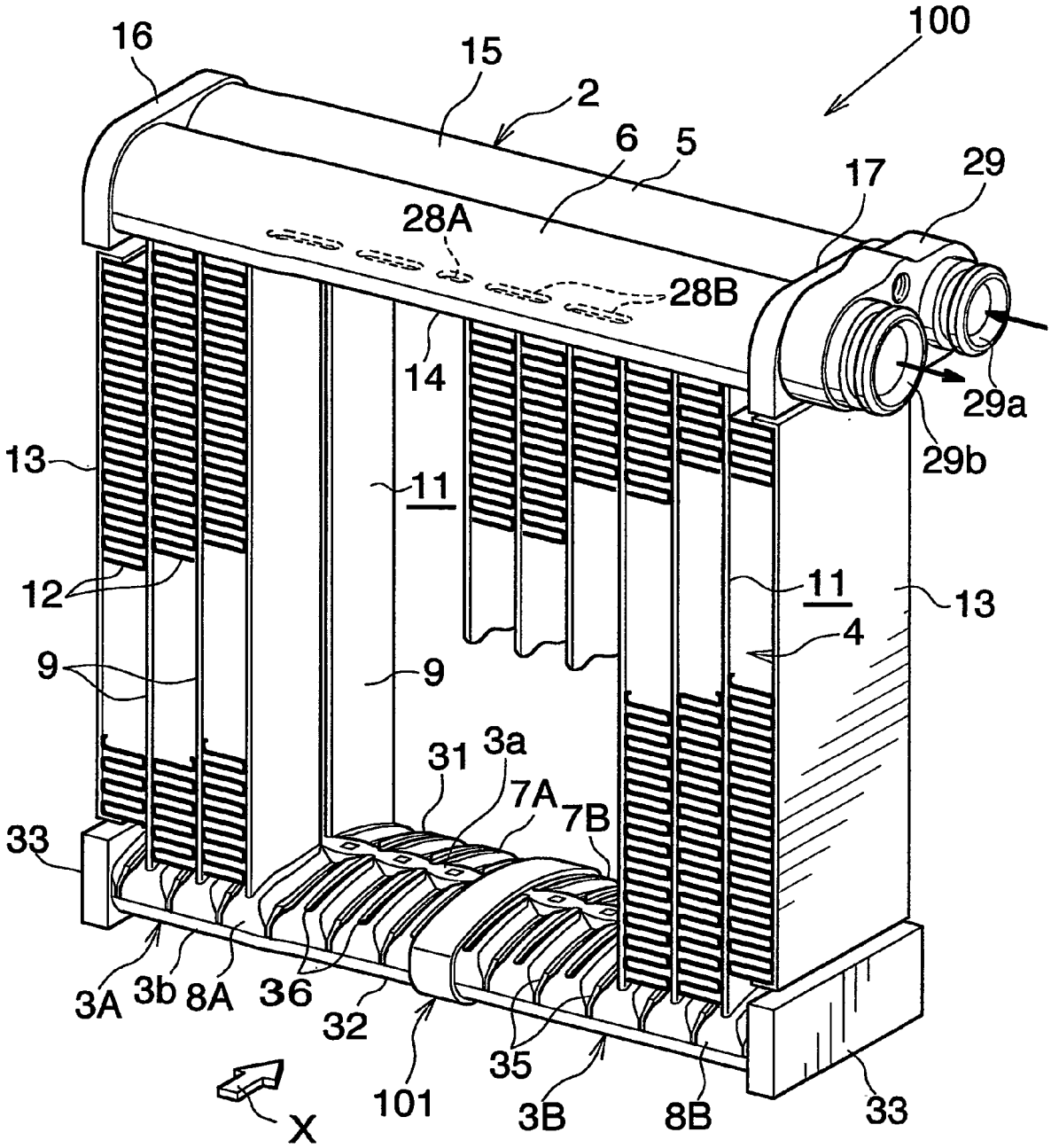
FIG. 18 is a perspective view partly broken away and showing the overall construction of a sixth embodiment of evaporator of the invention.
Figure 19:
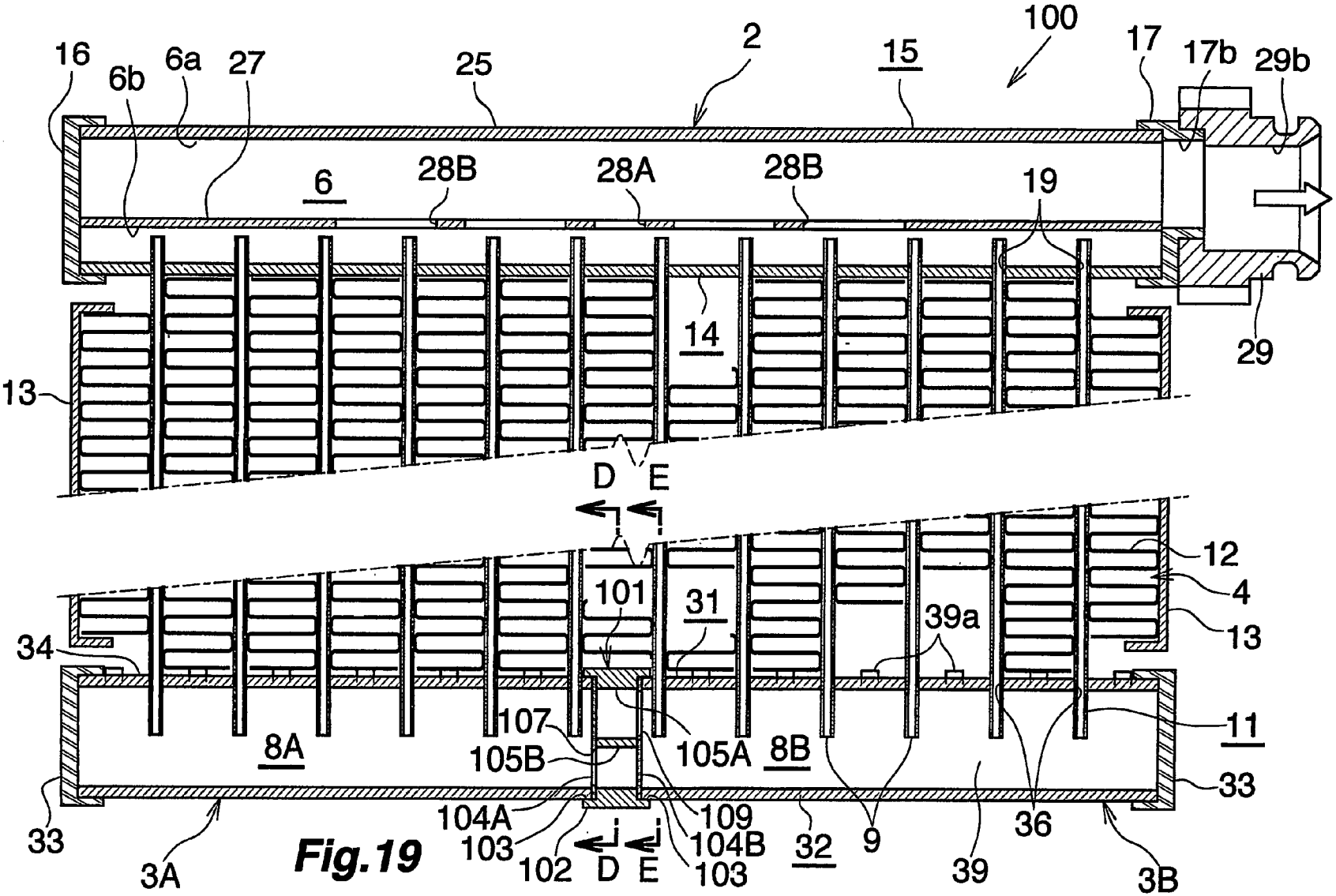
FIG. 19 is a view in vertical section and partly broken away of the evaporator shown in FIG. 18 as it is seen from behind.
Figure 22:
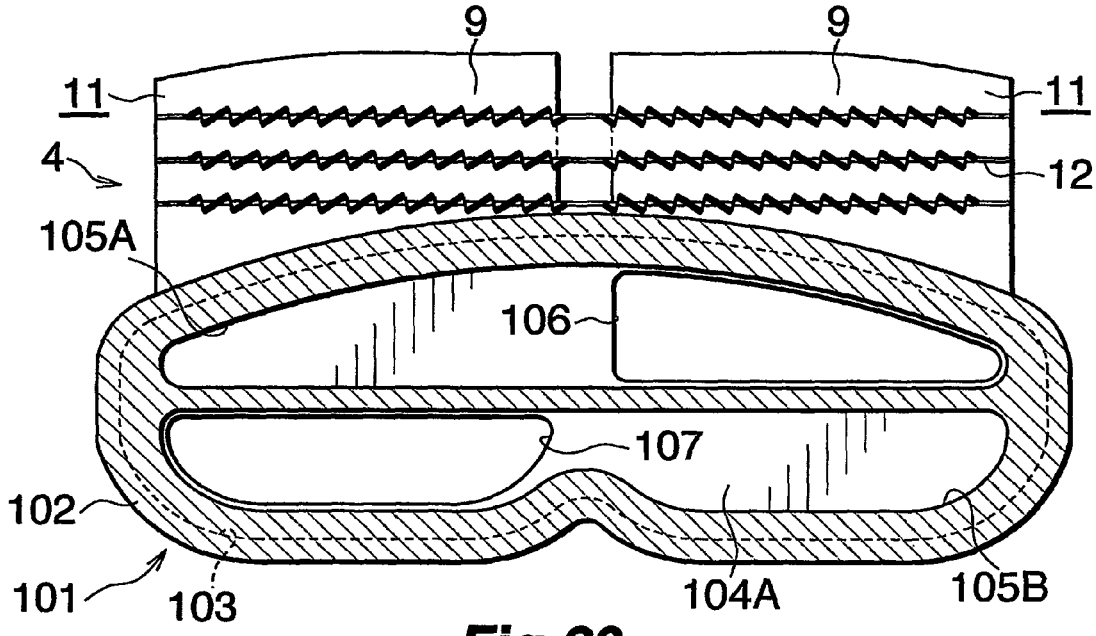
FIG. 22 is an enlarged views in section taken along the line D-D in FIG. 19.
Figure 23:
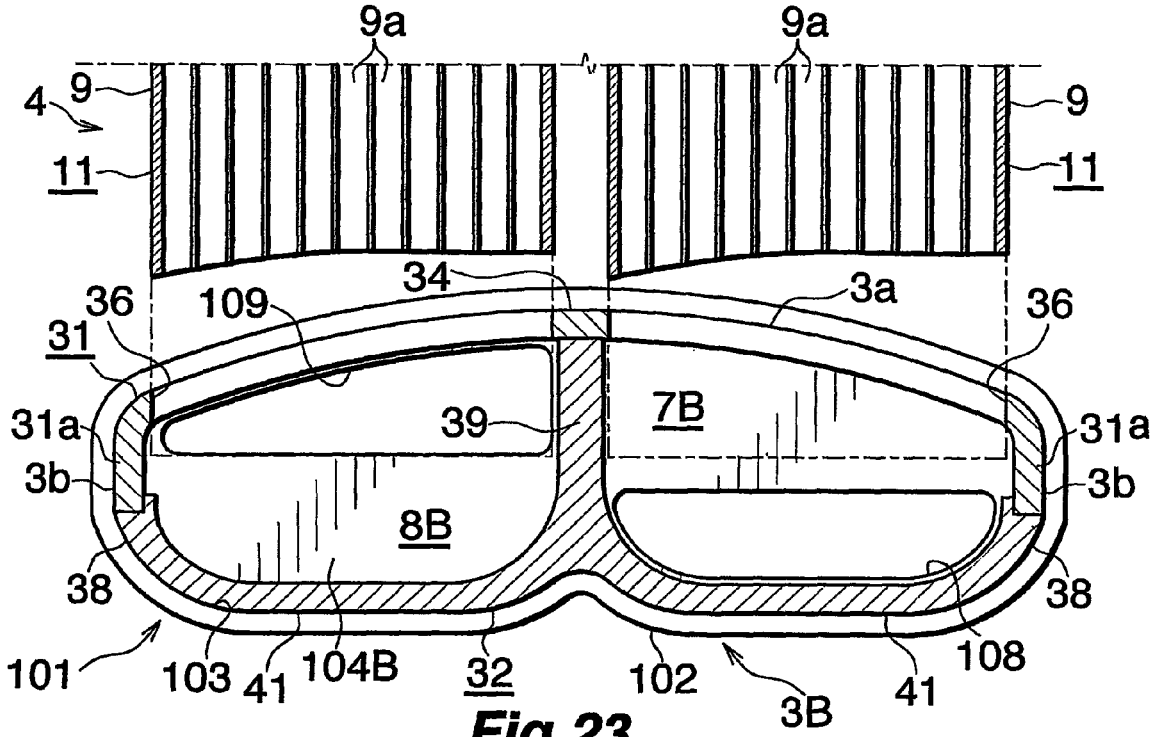
FIG. 23 is an enlarged view in section taken along the line E-E in FIG. 19.
Figure 24:
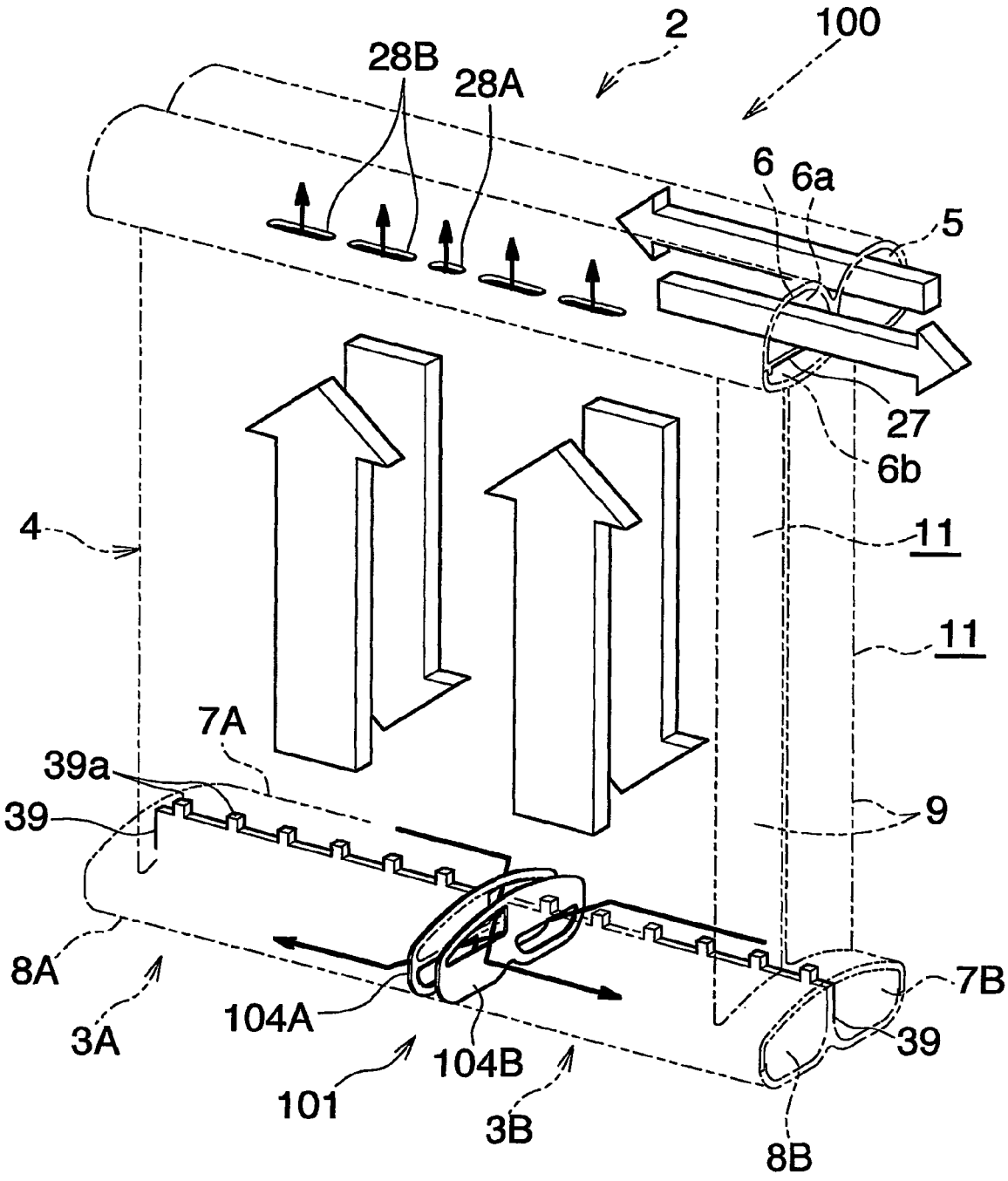
FIG. 24 is a diagram showing how a refrigerant flows through the evaporator shown in FIG. 18.

FIGS. 18 and 19 show the overall construction of a sixth embodiment of evaporator according to the invention for use in motor vehicle air conditioners, FIGS. 20 to 23 show the constructions of main portions, and FIG. 24 shows how the refrigerant flows through the evaporator of the sixth embodiment.

The evaporator 100 of this embodiment comprises left and right two refrigerant turn tanks 3A, 3B of aluminum which are arranged under a heat exchange core 4. Each turn tank 3A (3B) comprises a refrigerant inflow header 7A (7B) positioned on the front side and a refrigerant outflow header 8A (8B) positioned on the rear side.

Heat exchange tubes 9 positioned in the left half of a front tube group 11 of the core 4 have upper and lower end portions joined to a refrigerant inlet header 5 and the refrigerant inflow header 7A of the left turn tank 3A. Heat exchange tubes 9 positioned in the right half of the front group 11 have upper and lower end portions joined to the inlet header 5 and the refrigerant inflow header 7B of the right turn tank 3B. Heat exchange tubes 9 positioned in the left half of a rear tube group 11 of the core 4 have upper and lower end portions joined to a refrigerant outlet header 6 and the refrigerant outflow header 8A of the left turn tank 3A. Heat exchange tubes 9 positioned in the right half of the rear group 11 have upper and lower end portions joined to the outlet header 6 and the refrigerant outflow header 8B of the right turn tank 3B.

Figure 20:
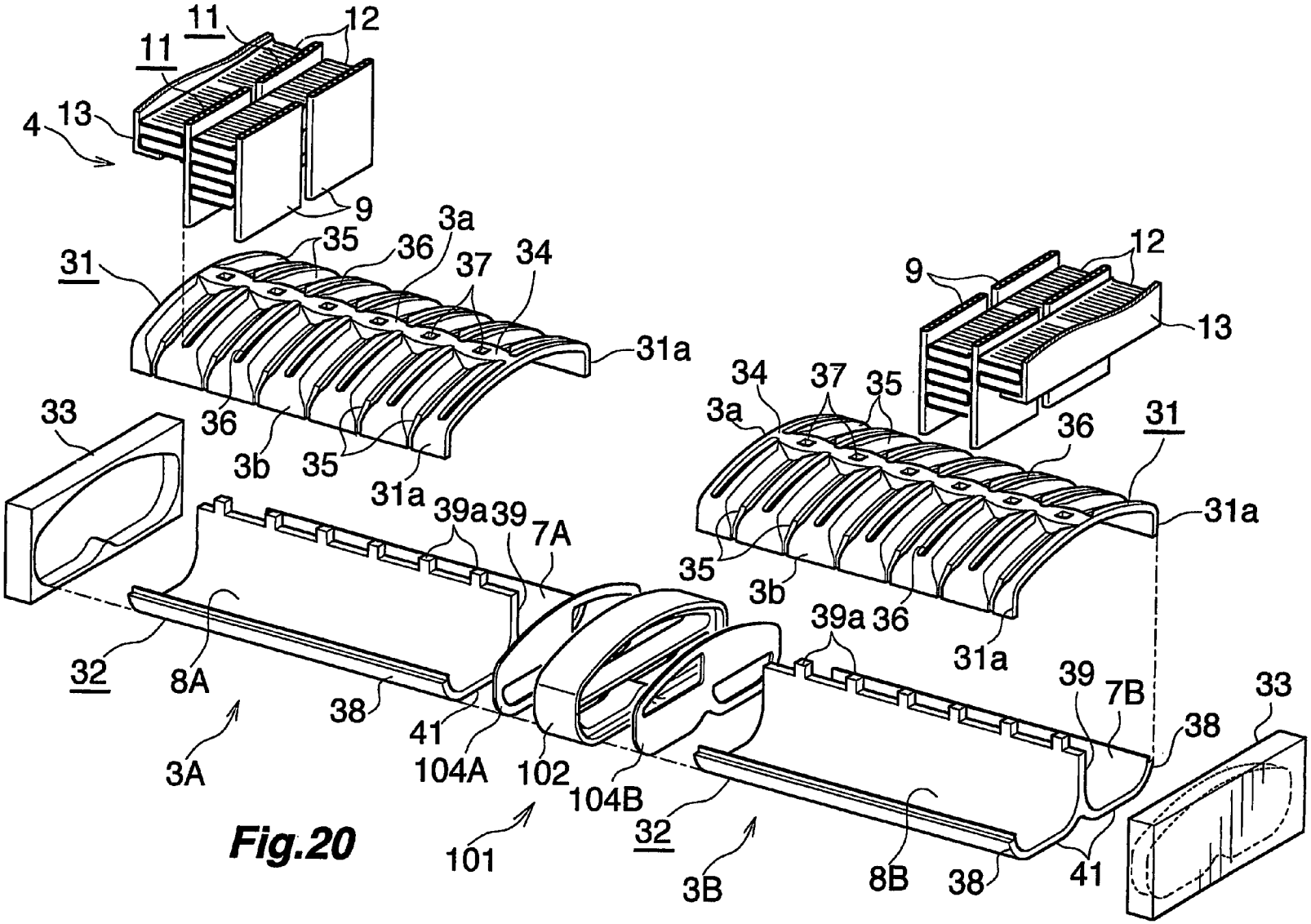
FIG. 20 is an exploded perspective view of two refrigerant turn tanks of the evaporator shown in FIG. 18.

With reference to FIG. 20, each of the left and right turn tanks 3A, 3B, like the turn tank 3 of the first embodiment, comprises a platelike first member 31 made of an aluminum brazing sheet having a brazing material layer over opposite surfaces thereof and having heat exchange tubes 9 joined thereto, and a second member 32 made of a bare aluminum extrudate and covering the lower side of the first member 31. A left-end opening of the left turn tank 3A and a right-end opening of the right turn tank 3B are each covered with an aluminum cap 33.

The first member 31 has the same construction as that of the first embodiment. The second member 32 has no cutout formed in a partition wall 39 thereof.

Figure 21:
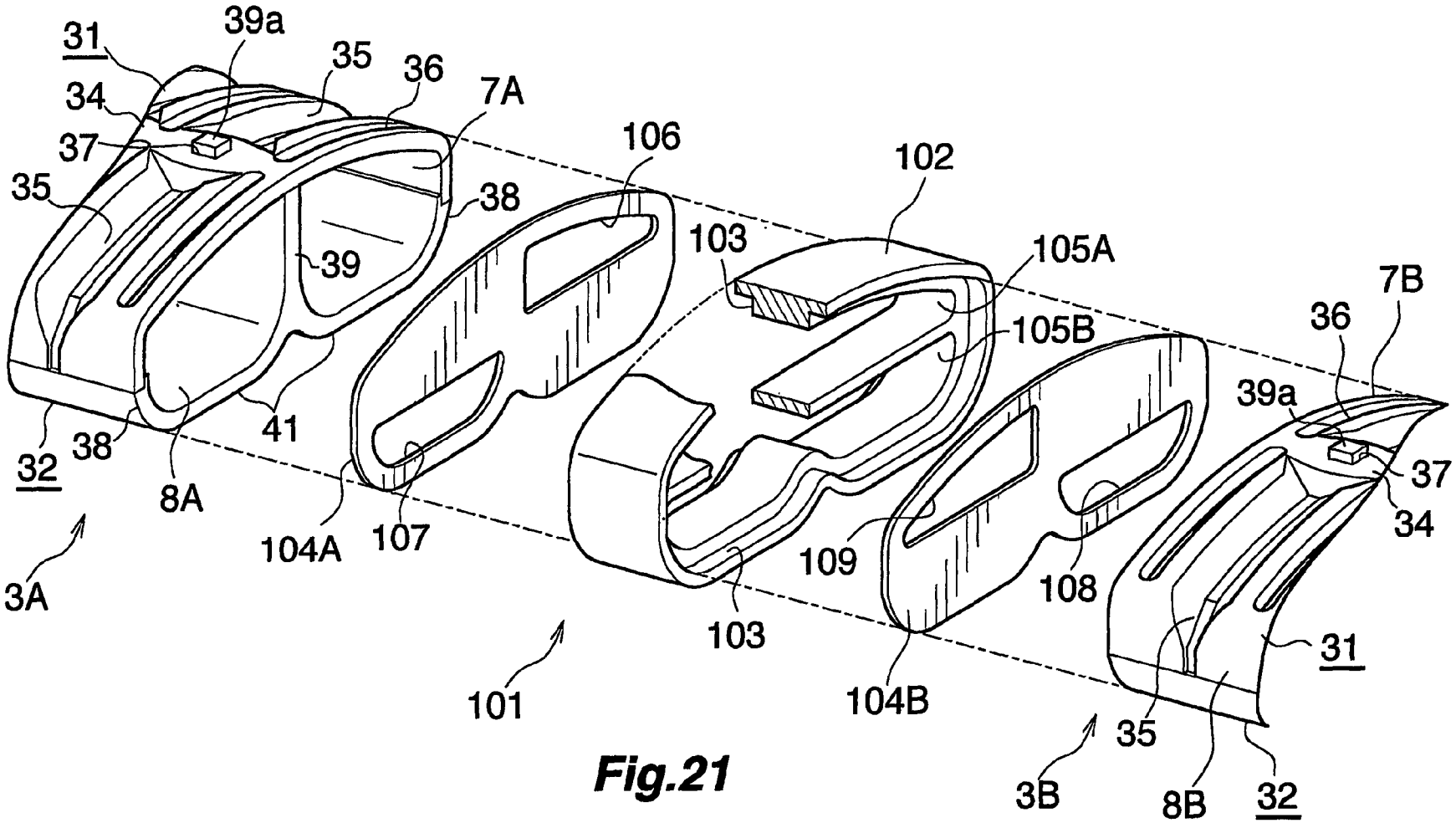
FIG. 21 is an exploded perspective view partly broken away and showing on an enlarged scale the portion of a refrigerant flow crossing device of the evaporator shown in FIG. 20.

Provided between the left turn tank 3A and the right turn tank 3B is a refrigerant flow crossing device 101 for causing the inflow header 7A of the left turn tank 3A to communicate with the outflow header 8B of the right turn tank 3B, and the inflow header 7B of the right turn tank 3B to communicate with the outflow header BA of the left turn tank 3A. As shown in FIGS. 21 to 23, the refrigerant flow crossing device 101 comprises a main aluminum block 102 provided in the left and right opposite sides thereof with respective recessed portions 103 having fitted therein the right end of the left turn tank 3A, i.e., the right ends of the first and second members 31, 32 thereof and the left end of the right turn tank 3B, i.e., the left ends of the first and second members 31, 32 thereof, respectively, and flow direction changeover aluminum plates 104A, 104B fitted in the opposite recessed portions 103 of the main block 102 and each interposed between the end face of the turn tank 3A or 3B and the bottom face of the recessed portion 103.

The main block 102 has forwardly or rearwardly elongated two communication holes 105A, 105B formed therein and vertically spaced apart for causing the upper parts of the opposite recessed portions 103, as well as the lower parts thereof, to communicate with each other. A through hole 106 is formed in an upper front portion of the left changeover plate 104A for causing the interior of the inflow header 7A of the left turn tank 3A to communicate with the interior of the upper communication hole 105A of the main block 102. A through hole 107 is formed in a lower rear portion of the same plate 104A for causing the interior of the outflow header 8A of the left turn tank 3A to communicate with the interior of the lower communication hole 105B of the main block 102. A through hole 108 is formed in a lower front portion of the right changeover plate 104B for causing the interior of the inflow header 7B of the right turn tank 3B to communicate with the interior of the lower communication hole 105B of the main block 102. A through hole 109 is formed in an upper rear portion of the same plate 104B for causing the interior of the outflow header 8B of the right turn tank 3B to communicate with the interior of the upper communication hole 105A of the main block 102. The inflow header 7A of the left turn tank 3A is made to communicate with the outflow header 8B of the right turn tank 3B via the through hole 106 of the left changeover plate 104A, the upper communication hole 105A of the main block 102 and the through hole 109 of the right changeover plate 104B. The inflow header 7B of the right turn tank 3B is made to communicate with the outflow header 8A of the left turn tank 3A via the through hole 108 of the right changeover plate 104B, the lower communication hole 105B of the main block 102 and the through hole 107 of the left changeover plate 104A.

The main block 102 is made from a bare aluminum material as by press work, forging or cutting. The flow direction changeover plates 104A, 104B are made from an aluminum brazing sheet having a brazing material layer over opposite surfaces thereof by press work.

The first and second members 31, 32 are brazed to each other utilizing the brazing material layer of the first member 31, with the projections 39*a* of the second member 32 inserted in the respective holes 37 of the first member 31 in crimping engagement and with the front and rear depending walls 31*a* of the first member 31 in engagement with the front and rear walls 38 of the second member 32. The two caps 33 are brazed to the first and second members 31, 32 using a brazing material sheet. The main block 102, the changeover plates 104A, 104B and the first and second members 31, 32 are brazed utilizing the brazing material layer of the changeover plates 104A, 104B. In this way, the left and right turn tanks 3A, 3B and the refrigerant flow crossing device 101 are made. The portion of each turn tank 3A (3B) forwardly of the partition wall 39 of the second member 32 serves as the refrigerant inflow header 7A (7B), and the portion thereof rearwardly of the partition wall 39 as the refrigerant outflow header 8A (8B).

The evaporator 1 is fabricated by tacking the components in combination and brazing the tacked assembly collectively.

With the exception of the features described above, the present evaporator is the same as the evaporator 1 of the first embodiment. Along with a compressor and a condenser, the evaporator constitutes a refrigeration cycle, which is installed in vehicles, e.g., in motor vehicles, for use as a motor vehicle air conditioner.

With reference to FIG. 24 showing the evaporator 100 described, a two-layer refrigerant of vapor-liquid mixture phase flowing through a compressor, condenser and expansion valve enters the refrigerant inlet header 5 of the refrigerant inlet-outlet tank 2 via the refrigerant inlet 29*a* of the refrigerant inlet-outlet member 29 and the refrigerant inflow opening 17*a* of the right cap 17 and dividedly flows into the refrigerant channels 9*a* of all the heat exchange tubes 9 of the front tube group 11.

The refrigerant flowing into the channels 9*a* of the heat exchange tubes 9 positioned in the left half of the front tube group 11 flows down the channels 9*a*, ingresses into the inflow header 7A of the left refrigerant turn tank 3A, and flows through the refrigerant flow crossing device 101, i.e., the through hole 106 in the upper front portion of the left flow direction changeover plate 104A, the upper communication hole 105A of the main block 102 and the through hole 109 in the upper rear portion of the right changeover plate 104B, into the outflow header 8B of the right refrigerant turn tank 3B. On the other hand, the refrigerant flowing into the channels 9*a* of the heat exchange tubes 9 positioned in the right half of the front tube group 11 flows down the channels 9*a*, ingresses into the inflow header 7B of the right refrigerant turn tank 3B, and flows through the refrigerant flow crossing device 101, i.e., the through hole 108 in the lower front portion of the right flow direction changeover plate 104B, the lower communication hole 105B of the main block 102 and the through hole 107 in the lower rear portion of the left changeover plate 104A, into the outflow header 8A of the left refrigerant turn tank 3A. At this time, the liquid-phase refrigerant portion and the vapor-phase refrigerant portion are mixed together.

The refrigerant flowing into the outflow headers 8A, 8B of the turn tanks 3A, 3B dividedly flows into the refrigerant channels 9*a* in the heat exchange tubes 9 of the rear group 11 joined to the outflow headers 8A, 8B, changes its course and passes upward through the channels 9*a* into the lower space 6*b* of the refrigerant outlet header 6 of the refrigerant inlet-outlet tank 2.

Subsequently, the refrigerant flows through the refrigerant passing holes 28A, 28B of the flow dividing resistance plate 27 into the upper space 6*a* of the outlet header 6 and flows out of the evaporator via the refrigerant outflow opening 17*b* of the cap 17 and the outlet 29*b* of the refrigerant inlet-outlet member 29. While flowing through the refrigerant channels 9*a* in the heat exchange tubes 9 of the front tube group 11 and the refrigerant channels 9*a* in the heat exchange tubes 9 of the rear tube group 11, the refrigerant is subjected to heat exchange with air flowing through the air passing clearances in the direction of arrow X shown in FIG. 18 and flows out of the evaporator in a vapor phase.

When the refrigerant flows through the evaporator 100 in the manner described above, the paths of flow of the refrigerant through the evaporator are given equal lengths unlike those described in the aforementioned publication, consequently resulting in a uniform pressure distribution and permitting the refrigerant to pass through all the heat exchange tubes 9 at a uniform rate. This uniformalizes the temperature of the air passing through the heat exchange core 4. In the case where the refrigerant flows through the heat exchange tubes 9 joined to the inflow header 7A of the left turn tank 3A at a reduced rate, and flows through the heat exchange tubes 9 joined to the inflow header 7B of the right turn tank 3B at an increased rate, the rate of flow of the refrigerant through the tubes 9 joined to the outflow header 8A of the left turn tank 3A increases, and the rate of flow of the refrigerant through the tubes 9 joined to the outflow header 8B of the right turn tank 3B decreases. Conversely in the case where the refrigerant flows through the heat exchange tubes 9 joined to the inflow header 7A of the left turn tank 3A at an increased rate, and flows through the heat exchange tubes 9 joined to the inflow header 7B of the right turn tank 3B at a reduced rate, the rate of flow of the refrigerant through the tubes 9 joined to the outflow header 8A of the left turn tank 3A decreases, and the rate of flow of the refrigerant through the tubes 9 joined to the outflow header 8B of the right turn tank 3B increases. This uniformalizes the amount of refrigerant contributing to heat exchange with respect to the left-right direction of the heat exchange core 4, consequently giving a generally uniform temperature to the air passing through the core.

One group 11 of heat exchange tubes is provided between the inlet header 5 and the inflow headers 7A, 7B of the left and right turn tanks 3A, 3B, and also between the outlet header 6 and the outflow headers 8A, 8B of the tanks 3A, 3B according to the foregoing sixth embodiment, whereas this arrangement is not limitative; one or at least two groups 11 of heat exchange tubes may be provided between the inlet header 5 and the inflow headers 7A, 7B of the two turn tanks 3A, 3B, also between the outlet header 6 and the outflow headers 8A, 8B of the tanks 3A, 3B. Although the refrigerant inlet-outlet tank 2 is positioned above the refrigerant turn tanks 3A, 3B which are at a lower level according to the foregoing embodiment, the evaporator may be used conversely with the turn tanks 3A, 3B positioned above the inlet-outlet tank 2.

Although embodiments have been described above all with reference to evaporators, the present invention is applicable also to other heat exchangers such as condensers.

INDUSTRIAL APPLICABILITY

The heat exchangers of the present invention are suitable, for example, for use as evaporators of motor vehicle air conditioners and exhibit improved heat exchange performance.

The invention claimed is:

1. A heat exchanger comprising:

a refrigerant inlet header and a refrigerant outlet header arranged side by side forwardly or rearwardly in a forward to rearward direction of the exchanger, and a refrigerant circulation passage for holding the inlet and outlet headers in communication with one another, the circulation passage being provided by a plurality of intermediate headers and a plurality of heat exchange tubes, the inlet header being opposed to one of the intermediate headers, the outlet header being opposed to another one of the intermediate headers, a group of heat exchange tubes arranged at a spacing laterally of the exchanger in at least one row between each of the opposed pairs of headers, the group of heat exchange tubes having opposite tube end portions joined to each opposed pair of headers, a refrigerant flowing into the inlet header being returnable to the outlet header through the circulation passage and flowable out of the outlet header, the outlet header having an interior divided by separating means into a plurality of spaces arranged in the direction of height, the heat exchange tubes joined to the outlet header being in communication with one of the spaces, a refrigerant outlet being provided in communication with another one of the spaces, the separating means having a plurality of spaced refrigerant passing holes formed laterally therein, each of the refrigerant passing holes being positioned between respective adjacent pairs of heat exchange tubes arranged longitudinally of the outlet header and included in the group of heat exchange tubes joined to the outlet header, and the distance between an end refrigerant passing hole to a respective end of the separating means is longer than the distance between said end refrigerant passing hole and an immediately adjacent refrigerant hole.

2. The heat exchanger according to claim 1 wherein the outlet header has its interior divided by the separating means into two spaces arranged in the direction of height.

3. The heat exchanger according to claim 1 wherein the intermediate headers are two in number, the intermediate header opposed to the inlet header serving as a refrigerant inflow header, the intermediate header opposed to the outlet header serving as a refrigerant outflow header, the inflow header being in communication with the outflow header, the refrigerant flowing into the inlet header being flowable into the inflow header through the heat exchange tubes joined to the inlet header, then into the outflow header, where the refrigerant changes its course to flow into said one space of the outlet header through the heat exchange tubes joined to the outlet header and then into said another space through the refrigerant passing holes of the separating means, the refrigerant thereafter being flowable out of the outlet header.

4. The heat exchanger according to claim 1 wherein the separating means of the outlet header has the refrigerant passing holes formed in a portion thereof other than opposite end portions thereof with respect to the longitudinal direction of the outlet header.

5. The heat exchanger according to claim 1 wherein the inlet header has a refrigerant inlet at one end thereof, and the outlet header has the refrigerant outlet at one end thereof alongside the inlet end.

6. The heat exchanger according to claim 1 wherein the refrigerant passing holes are formed in the separating means of the outlet header in a rear portion thereof.

7. The heat exchanger according to claim 1 wherein the heat exchange tubes joined to the outlet header are at least ten in number.

8. The heat exchanger according to claim 1 wherein the inlet header and the outlet header are provided by dividing interior of a refrigerant inlet-outlet tank into a front and a rear space by partitioning means.

9. The heat exchanger according to claim 8 wherein the inlet-outlet tank comprises a first member having the heat exchange tubes joined thereto, a second member brazed to the first member at a portion thereof opposite to the heat exchange tubes and caps brazed to opposite ends of the first and second members, and the separating means and the partitioning means are integral with the second member.

* * * * *